US008745958B2

(12) United States Patent
Kang et al.

(10) Patent No.: US 8,745,958 B2
(45) Date of Patent: Jun. 10, 2014

(54) 3-DIMENSIONAL LATTICE TRUSS STRUCTURE COMPOSED OF HELICAL WIRES AND METHOD FOR MANUFACTURING THE SAME

(75) Inventors: Ki Ju Kang, Jeollanam-do (KR); Seung Chul Han, Gwangju (KR); Jai Hwang Joo, Jeollanam-do (KR)

(73) Assignee: Industry Foundation of Chonnam National University, Gwangju (KR)

( * ) Notice: Subject to any disclaimer, the term of this patent is extended or adjusted under 35 U.S.C. 154(b) by 3 days.

(21) Appl. No.: 13/391,719

(22) PCT Filed: Aug. 25, 2010

(86) PCT No.: PCT/KR2010/005710

§ 371 (c)(1),
(2), (4) Date: Feb. 22, 2012

(87) PCT Pub. No.: WO2011/025268

PCT Pub. Date: Mar. 3, 2011

(65) Prior Publication Data

US 2012/0151868 A1 Jun. 21, 2012

(30) Foreign Application Priority Data

Aug. 27, 2009 (KR) ..... 10-2009-0080085

(51) Int. Cl.
*E04B 1/00* (2006.01)
*E04B 1/19* (2006.01)

(52) U.S. Cl.
CPC ..... *E04B 1/19* (2013.01)
USPC ..... 52/745.19; 52/652.1; 52/664

(58) Field of Classification Search
USPC ..... 52/649.7, 648.1, 649.2–649.4, 652.1, 52/656.8, 660, 664, 665, 745.19
See application file for complete search history.

(56) References Cited

U.S. PATENT DOCUMENTS 2,986,241 A 5/1961 Fuller
3,546,049 A * 12/1970 Kostick ..... 52/650.2

(Continued)

FOREIGN PATENT DOCUMENTS

KR 10-0566729 B1 3/2006
KR 10-2006-0110091 A 10/2006

(Continued)

OTHER PUBLICATIONS

S. Hyun et al., "Simulated properties of Kagome and tetragonal truss core panels", International Journal of Solids and Structures, 2003, pp. 6989-6998, vol. 40.

(Continued)

*Primary Examiner* — William Gilbert
*Assistant Examiner* — Gisele Ford
(74) *Attorney, Agent, or Firm* — Sherr & Jiang, PLLC

(57) ABSTRACT

Disclosed are three-dimensional porous light-weight structures composed of helical wires and the manufacturing method of the same. Continuous helical wire groups in three or six directions having a designated angle (for example, 60 degrees or 90 degrees) with respect to one another in a space cross and are then assembled, and thus new truss-shaped three-dimensional lattice truss structures having high strength and stiffness to weight ratio and a large surface area and method of mass-producing the structures at low costs are provided. The three-dimensional porous light-weight structures are manufactured by a method in which helical wires are three-dimensionally assembled through a continuous process rather than a method in which net-shaped wires are simply woven and stacked, and thus have a configuration similar to the ideal hexahedron truss, Octet truss, or truss in which regular octahedrons and cuboctahedrons are combined, thereby having excellent mechanical properties or thermal or aerodynamic properties.

3 Claims, 49 Drawing Sheets

(56) References Cited

U.S. PATENT DOCUMENTS

| | | | | | |
|---|---|---|---|---|---|
| 5,097,646 | A | * | 3/1992 | Lamle | 52/649.1 |
| 5,265,395 | A | * | 11/1993 | Lalvani | 52/648.1 |
| 5,505,035 | A | * | 4/1996 | Lalvani | 52/648.1 |
| 5,527,590 | A | * | 6/1996 | Priluck | 428/198 |
| 5,660,003 | A | * | 8/1997 | Owens | 52/81.1 |
| 5,921,048 | A | * | 7/1999 | Francom et al. | 52/637 |
| 8,042,312 | B2 | * | 10/2011 | Kang et al. | 52/664 |
| 8,286,392 | B2 | * | 10/2012 | Noble et al. | 52/79.4 |
| 8,418,730 | B2 | * | 4/2013 | Kang et al. | 140/5 |
| 2007/0095012 | A1 | | 5/2007 | Kang et al. | |
| 2010/0071300 | A1 | | 3/2010 | Kang et al. | |

FOREIGN PATENT DOCUMENTS

| | | | |
|---|---|---|---|
| KR | 10-2006-0130539 | A | 12/2006 |
| KR | 10-0708483 | B1 | 4/2007 |
| KR | 10-0720109 | B1 | 5/2007 |
| KR | 10-2009-0039500 | A | 4/2009 |

OTHER PUBLICATIONS

S. Chiras et al., "The structural performance of near-optimized truss core panels", International Journal of Solids and Structures, 2002, pp. 4093-4115, vol. 39.

David J. Sypeck et al., "Cellular Metal Truss Core Sandwich Structures", Advanced Engineering Materials, 2002, pp. 759-764, vol. 4, No. 10.

D.J. Sypeck et al., "Multifunctional microtruss laminates: Textile synthesis and properties", J. Mater. Res., Mar. 2001, pp. 890-897, vol. 16, No, 3.

R. Buckminster Fuller, "Synergetics: Explorations in the Geometry of Thinking",1975, pp. 669, Macmillan Publishing Company, New York.

* cited by examiner

3-DIMENSIONAL LATTICE TRUSS STRUCTURE COMPOSED OF HELICAL WIRES AND METHOD FOR MANUFACTURING THE SAME

CROSS REFERENCE TO PRIOR APPLICATIONS

This application is a National Stage Patent Application of PCT International Patent Application No. PCT/KR2010/005710 (filed on Aug. 25, 2010) under 35 U.S.C. §371, which claims priority to Korean Patent Application No. 10-2009-0080085 (filed on Aug. 27, 2009), which are all hereby incorporated by reference in their entirety.

TECHNICAL FIELD

The present invention relates to three-dimensional lattice truss structures composed of helical wires and manufacturing method of the same, more particularly to three-dimensional light-weight structures which have a configuration similar to the ideal truss, high strength and stiffness per weight and a large surface area, and method of mass-producing (manufacturing) the same at low costs.

BACKGROUND ART

Conventionally, metal foam is a commonly used material as a porous light-weight structure. Such metal foam is manufactured through a method (in the case of a close type) of generating air bubbles within metal in a liquid state or a semi-solid state, or a method (in the case of an open type) of casting using an open-type foamed resin, such as a sponge, as a mold. However, since the metal foam has relatively poor physical properties, such as strength and stiffness, and high production costs, the metal foam is not practically used except in specific fields, such as aerospace.

As a material substituting for the metal foam, there is an open-type light-weight structure having a periodic truss configuration. Such a structure has the truss configuration designed to have the optimal strength and stiffness through minute mathematical/dynamical calculation, thus having excellent mechanical properties. As a shape of the truss structure, an Octet truss in which regular tetrahedrons and regular octahedrons are combined is the most general (R. Buckminster Fuller, 1961, U.S. Pat. No. 2,986,241). Here, since respective elements of the truss form a regular triangle, such an Octet truss has excellent strength and stiffness. Recently, a Kagome truss modified from the Octet truss has been announced (S. Hyun, A. M. Karlsson, S. Torquato, A. G. Evans, 2003. Int. J. of Solids and Structures, Vol. 40, pp. 6989-6998).

With reference to FIG. 1, an Octet truss 101 and a Kagome truss 102 are two-dimensionally compared. Differently from a unit cell 101*a* of the Octet truss 101, a unit cell 102*a* of the Kagome truss 102 has a structure such that both a regular triangle and a regular hexagon are provided at each side.

FIGS. 2 and 3 respectively illustrate one layer of each of a three-dimensional Octet truss 201 and a three-dimensional Kagome truss 202. Through comparison between a unit cell 201*a* of the three-dimensional Octet truss 201 and a unit cell 202*a* of the three-dimensional Kagome truss 202, one of important characteristics of the three-dimensional Kagome truss 202 is that the three-dimensional Kagome truss 202 has an isotropic structure and thus mechanical properties and electrical properties of a structural material or other materials having the three-dimensional Kagome truss 202 are uniform regardless of direction.

As a manufacturing method of a truss-shaped porous light-weight structure, several methods, as described below, are known. The first method comprises making a mold has a truss structure formed of a resin and then manufacturing a porous light-weight structure by casting metal using the mold (S. Chiras, D. R. Mumm, N. Wicks, A. G. Evans, J. W. Hutchinson, K. Dharmasena, H. N. G. Wadley, S. Fichter, 2002, International Journal of Solids and Structures, Vol. 39, pp. 4093~4115). The second method comprises forming a net by periodically perforating a thin metal plate, bending the net to form a truss intermediate layer and then attaching face plates to the upper and lower surface of the intermediate layer (D. J. Sypeck and H. N. G. Wadley, 2002, Advanced Engineering Materials, Vol. 4, pp. 759~764). In this case, to manufacture a porous light-weight structure having multiple layers, such as two or more layers, mounting a truss intermediate layer formed by bending a net on the upper face plate and then attaching another face plate to the upper surface thereof. The third method comprises weaving wire meshes using wires in two directions perpendicular to each other, and then stacking and bonding the wire meshes (D. J. Sypeck and H. G. N. Wadley, 2001, J. Mater. Res., Vol. 16, pp. 890~897).

The above first method involves a complicated manufacturing process and high costs and is capable of manufacturing a truss-shaped porous light-weight structure using only metal having excellent castability and thus has a narrow application range, and a product obtained through the first method tends to have many defects and low strength in terms of characteristics of a casting constitution. The second method causes large material loss during a process of perforating the thin metal plate and does not cause a problem in the case of a sandwich plate material having one layer of the truss, but in order to manufacture a structure having several layers, multiple layers of the trusses are stacked and bonded and thus the number of boning portions is excessively increased and thus the second method is disadvantageous in terms of bonding costs and strength.

Further, in the case of the third method, the manufactured truss does not have an ideal shape, such as a regular tetrahedron or a pyramid, and thus has low mechanical strength, and the truss is formed by stacking and bonding the wire meshes in the same manner as the second method and thus the number of bonding parts is excessively increased and the third method is disadvantageous in terms of bonding costs and strength.

FIG. 4 illustrates a structure manufactured using the above third method, i.e., a light-weight structure manufactured by stacking wire meshes. It is known that such a method may reduce manufacturing costs, but since wires in two directions are simply woven like weaving of a fiber, the structure does not have an ideal configuration having the optimal mechanical properties and electrical properties like the above-described three-dimensional Octet truss 201 and three-dimensional Kagome truss 202 and the number of parts to be bonded is excessively increased and the third method is disadvantageous in terms of bonding costs and strength.

A general fiber-reinforced composite material is manufactured in the shape of a two-dimensional thin lamina, and if a thick material is required, laminas are stacked.

However, in this case, the laminas may be separated from each other and thus strength of the manufactured material is lowered. Therefore, a method in which fibers are three-dimensionally woven from the beginning and are then combined with a matrix, such as a resin, metal, etc., is used.

FIG. 5 illustrates a fiber-woven shape of such a three-dimensional fiber-reinforced composite material. Instead of fibers, using a material having large stiffness, such as a metal wire, a porous light-weight structure may be manufactured through three-dimensional weaving, as shown in FIG. 5. However, the porous light-weight structure also does not have the ideal Octet and Kagome truss configuration, and thus has low mechanical strength and different physical properties according to direction. For this reason, the composite material manufactured of the three-dimensionally woven fibers has poor mechanical properties.

Considering the above problems, the inventors (2 persons including Ki-Ju Kang) of the present invention developed a three-dimensional porous light-weight structure which is formed in a regular shape similar to the ideal Kagome truss or Octet truss shape by crossing continuous wire groups in six directions having an azimuth angle of 60 or 120 degrees with respect to one another in a space, and a manufacturing method thereof, and the contents of the three-dimensional porous light-weight structure and the manufacturing method thereof are disclosed in Korean Patent Reg. No. 0708483.

Further, in order to more effectively manufacture a three-dimensional porous light-weight structure, the inventors proposed a three-dimensional porous light-weight structure woven by helical wires which is assembled by forming continuous wires into a helical shape and then inserting the helical wires while spinning the same, and a manufacturing method thereof, and the contents of the three-dimensional porous light-weight structure and the manufacturing method thereof are disclosed in Korean Patent Laid-open No. 2006-0130539.

The above-described three-dimensional porous light-weight structures disclosed in the Patents filed by the inventors of the present invention have several advantages, such as excellent mechanical properties and mass production at low costs through a continuous process, as compared to the conventional structures. However, if these three-dimensional porous light-weight structures are manufactured in a rectangular parallel piped shape, which is widely used, the shape of unit cells located at the corners is not perfect and thus the three-dimensional porous light-weight structures are disadvantageous in terms of appearance and mechanical strength, and increase in arrangement density of wires is limited due to interference among the wires. Accordingly, the inventors propose manufacturing methods of new three-dimensional porous light-weight structures which have different shapes from the Kagome truss while being manufactured by wires formed in a helical shape.

DISCLOSURE

Technical Problem

Therefore, the present invention has been made in view of the above problems, and it is an object of the present invention to provide three types of new three-dimensional lattice truss structures having high strength and stiffness to weight ratio and a large surface area in which continuous helical wire groups in three or six directions having a designated angle (for example, 60 degrees or 90 degrees) with one another in a space are crossed and then assembled, method of mass-producing the structures at low costs.

It is another object of the present invention to provide new three-dimensional lattice truss structures which have shapes different from the Kagome truss while being manufactured using helical wires, and manufacturing method thereof.

It is another object of the present invention to provide three-dimensional lattice truss structures in which the shape of unit cells located at the lateral surfaces can be intact when the structures are manufactured in a rectangular parallel piped shape, appearance and mechanical strength are excellent and arrangement density of wires can be higher than the Kagome truss, and manufacturing method thereof.

It is another object of the present invention to provide three-dimensional lattice truss structures which are manufactured by method in which helical wires are three-dimensionally assembled through a continuous process rather than method in which wire meshes are simply woven and stacked, and have a configuration very similar to the ideal hexahedron truss, Octet truss, or truss in which regular octahedrons and cuboctahedrons are combined, so as to have excellent mechanical properties or thermal or aerodynamic properties, and manufacturing method thereof.

It is another object of the present invention to provide three-dimensional lattice truss structures in which the intersections of wires are bonded through welding, brazing, soldering or using a liquid or spray-type adhesive agent, as needed, so as to be applicable to a structural material having light weight and high strength and stiffness or a porous material having a large surface area, and manufacturing method thereof.

It is a further object of the present invention to provide three-dimensional lattice truss structures which are applicable to a three-dimensional fiber-reinforced composite material by filling the entirety or a portion of a vacant space of the structures with a resin, metal or an inorganic material, and manufacturing method thereof.

Technical Solution

In accordance with an aspect of the present invention, the above and other objects can be accomplished by the provision of manufacturing method of three-dimensional porous light-weight structures composed of helical wires including forming a hexahedron truss structure by crossing continuous helical wire groups in three directions having an azimuth angle of 90 degrees with respect to one another in a space, or forming an Octet truss structure or a truss structure, in which regular octahedrons and cuboctahedrons are combined, by crossing continuous helical wire groups in six directions having an azimuth angle of 90 degrees or 60 degrees with respect to one another in a space.

In the manufacturing method, the formation of the hexahedron truss structure may include (a) forming plural net-shaped planes, each of which has plural rectangular meshes by arranging plural helical wires in parallel in first and second axial directions on one plane, (b) arranging the plural net-shaped planes at a designated interval in parallel in a direction perpendicular to the planes, and (c) forming the hexahedron truss structure by respectively inserting helical wires in a third axial direction into the intersections of the helical wires in the first and second axial directions arranged on the plural planes, the helical wires in the first and second axial directions may have an azimuth angle of 90 degrees with respect to each other, and the helical wires in the third axial direction may have an azimuth angle of 90 degrees with respect to the helical wires in the first and second axial directions.

In the manufacturing method, the formation of the Octet truss structure may include (a) forming plural net-shaped planes, each of which has plural triangular meshes by arranging plural helical wires in parallel in first to third axial directions on one plane, (b) arranging the plural net-shaped planes at a designated interval in parallel in a direction perpendicular to the planes, and (c) forming the Octet truss structure by respectively inserting plural helical wires in fourth to sixth axial directions into the intersections of the helical wires in the first to third axial directions arranged on the plural planes, the helical wires in the first to third axial directions may have an azimuth angle of 60 degrees with respect to one another.

In the manufacturing method, the formation of the Octet truss structure may include (a) forming plural net-shaped planes, each of which has plural rectangular meshes by arranging plural helical wires in parallel in first and second axial directions on one plane, (b) arranging the plural net-shaped planes at a designated interval in parallel in a direction perpendicular to the planes, and (c) forming the Octet truss structure by respectively inserting plural helical wires in third to sixth directions into the intersections of the helical wires in the first and second axial directions arranged on the plural planes, the helical wires in the first and second axial directions may have an azimuth angle of 90 degrees with respect to each other, and the helical wires in the third to sixth axial directions may have an azimuth angle of 60 degrees with respect to the helical wires in the two directions arranged at the intersections and may have an azimuth angle of 45 degrees with a plane formed by a first axis and a second axis.

In the manufacturing method, the formation of the truss structure in which the regular octahedrons and the cuboctahedrons are combined may include (a) forming plural two-dimensional Kagome planes by arranging plural helical wires in parallel in first to third axial directions on one plane, (b) arranging the plural two-dimensional Kagome planes at a designated interval in parallel in a direction perpendicular to the planes, and (c) forming the truss structure in which the regular octahedrons and the cuboctahedrons are combined by respectively inserting plural helical wires in fourth to sixth directions into the intersections of the helical wires in the three axial directions arranged on the plural two-dimensional Kagome planes, and the wires in the four directions including the wires in the two axial directions in-plane and the wires in the two axial directions out-of-plane may pass through the respective intersections of the helical wires.

In the manufacturing method, the formation of the truss structure in which the regular octahedrons and the cuboctahedrons are combined may include (a) forming plural net-shaped planes, each of which has plural rectangular meshes by arranging plural helical wires in parallel in first and second axial directions on one plane, (b) arranging the plural net-shaped planes at a designated interval in parallel in a direction perpendicular to the planes, and (c) forming the truss structure in which the regular octahedrons and the cuboctahedrons are combined by respectively inserting plural helical wires in third to sixth directions into the intersections of the helical wires in the first and second axial directions arranged on the plural planes such that the helical wires in two axial directions cross each intersection, and the wires in the four directions including the wires in the two axial directions in-plane and the wires in the two axial directions out-of-plane may pass through the respective intersections of the helical wires.

In accordance with another aspect of the present invention, there is provided a three-dimensional porous light-weight structure manufactured by the manufacturing method.

In the three-dimensional porous light-weight structure, the helical wires may be bonded at the respective intersections using one of bonding methods including a method using a liquid or spray-type adhesive, brazing, soldering and welding.

In the three-dimensional porous light-weight structure, a three-dimensional fiber-reinforced composite material may be manufactured by filling the entirety or a portion of a vacant space of the three-dimensional porous light-weight structure with a liquid or semi-solid resin, metal or inorganic material.

Advantageous Effects

In accordance with the present invention, from among helical wires in six axial directions, the helical wires in two or three axial directions are first assembled with a frame to form a plurality of two-dimensional planes, the helical wires in the remaining axial directions are directly inserted or are rotated and inserted into the wires forming the two-dimensional planes of the frame to manufacture three kinds of three-dimensional porous light-weight structures. Therefore, the three-dimensional porous light-weight structures composed of continuous wires may be easily mass-produced at low costs. The three types of the three-dimensional porous light-weight structures increase the scope of selection of arrangement density of the wires and the shape of cells located at the corners.

Further, the three-dimensional porous light-weight structures in accordance with the present invention which are manufactured using the continuous helical wires improve approaching performance between the wires without damage applied to an intended truss structure, and thus may maintain an assembled shape without a separate external support and may simplify a manufacturing process. Moreover, since the wire intersections are fixed through welding, brazing, soldering or using a liquid adhesive agent, the three-dimensional porous light-weight structures in accordance with the present invention may have desired mechanical properties.

DESCRIPTION OF DRAWINGS

The above and other objects, features and other advantages of the present invention will be more clearly understood from the following detailed description taken in conjunction with the accompanying drawings, in which:

FIG. 6 is a plan view of a structure similar to the two-dimensional Kagome truss of FIG. 1 manufactured using parallel wire groups in three directions;

FIG. 7 is a perspective view of a unit cell corresponding to the portion A of FIG. 6 when the two-dimensional structure of FIG. 6 is converted into a structure similar to the three-dimensional Kagome truss of FIG. 3;

FIG. 8 is a perspective view illustrating a state in which a unit cell of the Kagome truss of FIG. 3 is composed of wires in six directions;

FIG. 9 is a perspective view of a three-dimensional Kagome truss-shaped porous structure manufactured using wire groups in six directions;

FIG. 10 illustrates perspective views of the structure of FIG. 9, as seen from different angles;

FIG. 11 is a perspective view of apexes of regular tetrahedrons formed by wire groups in three directions in the structure of FIG. 9, as seen from the front of the apexes; and FIG. 12 is a perspective view of unit cells formed by different wire crossing methods of FIG. 11;

FIG. 13 illustrates a shape of a hexahedron truss;

FIG. 14 illustrates a shape in which plural layers of an Octet truss are arranged;

FIG. 15 illustrates the Octet truss of FIG. 14 rotated such that a regular tetragonal net-shaped plane is parallel with the x-y plane;

FIG. 16 illustrates a multi-layer truss structure in which plural regular octahedrons and cuboctahedrons are combined;

FIG. 17 illustrates the truss structure rotated such that a regular tetragonal net-shaped plane is parallel with the x-y plane;

BEST MODE

Figure 1:
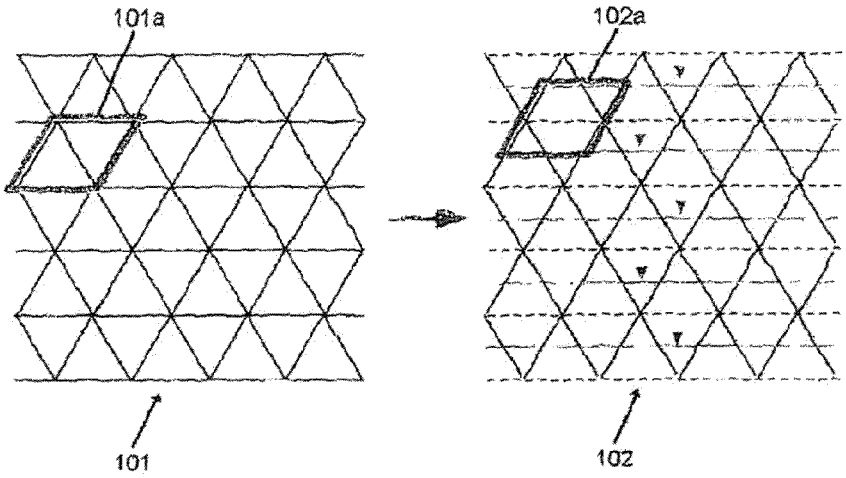
FIG. 1 is a view to two-dimensionally compare conventional Octet truss and Kagome truss structures.
Figure 2:
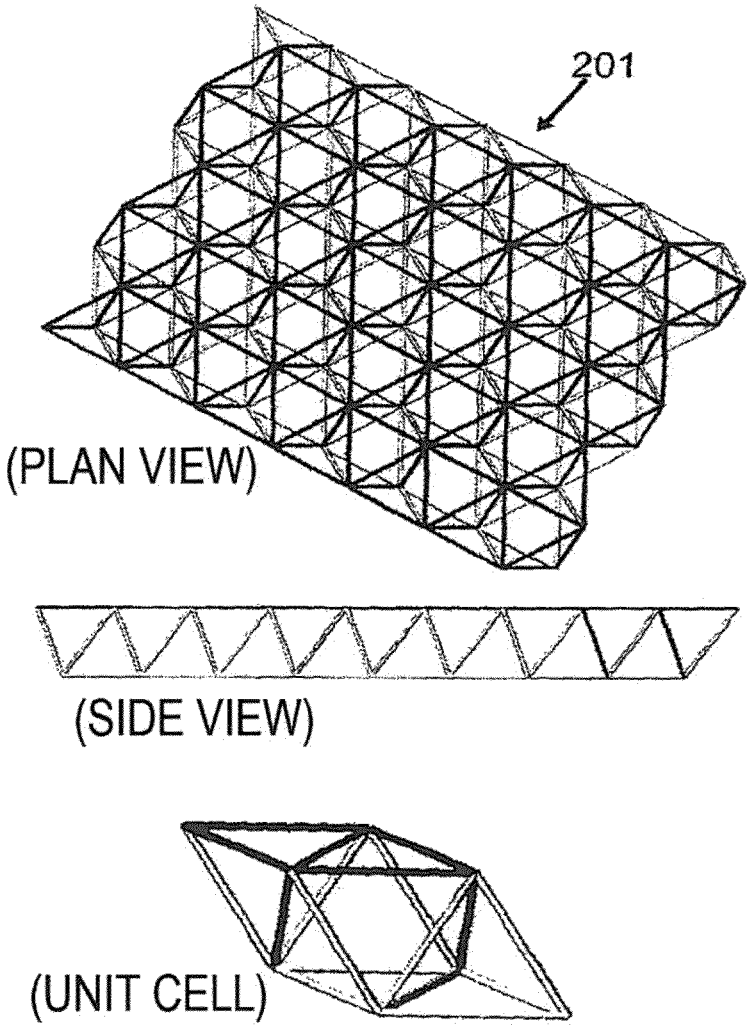
FIG. 2 illustrates plan and side views of one layer of a conventional three-dimensional Octet truss and a perspective view of a unit cell of the Octet truss.

Now, preferred embodiments of the present invention will be described in detail with reference to the annexed drawings so that those skilled in the art will easily be able to implement the present invention. Although the preferred embodiments of the present invention have been disclosed for illustrative purposes, those skilled in the art will appreciate that various modifications, additions and substitutions are possible. Further, in the drawings, elements which are not related to the description of the present invention will be omitted when it may make the subject matter of the present invention rather unclear, and some parts which are similar throughout the description are denoted by similar reference numerals even though they are depicted in different drawings.

Before a detailed description of an embodiment of the present invention, for a better understanding of the present invention, the contents disclosed in Patent Reg. No. 0708483 filed by the inventors of the present invention will be described in brief with reference to FIGS. 6 to 12.

Figure 6:
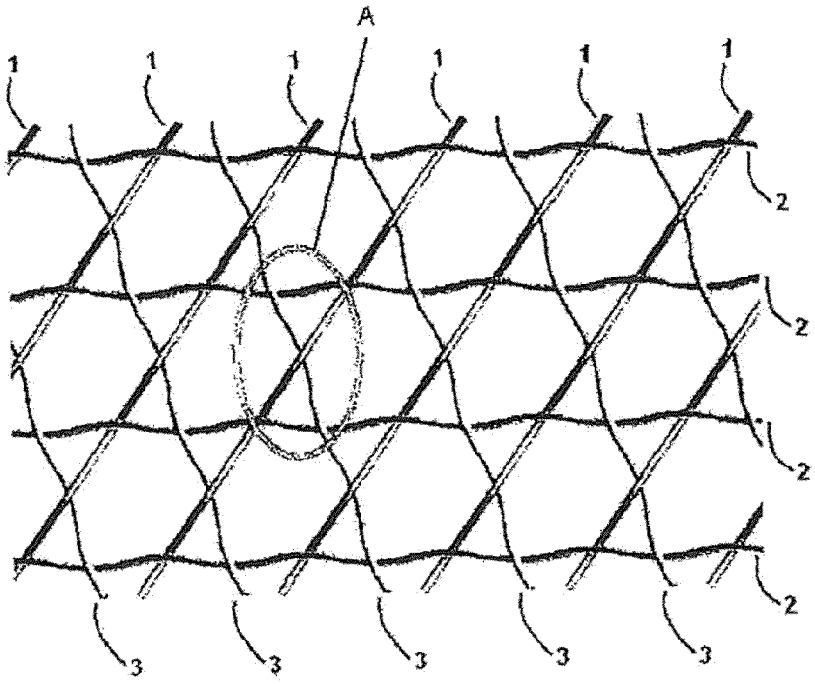
FIGS. 6 to 12 are views illustrating the technical contents disclosed in Patent Registration No. 0708483 filed by the inventors of the present invention for a better understanding of the present invention, and in more detail.

First, a three-dimensional porous light-weight structure will be described. FIG. 6 illustrates the structure formed by wire groups 1, 2 and 3 in three directions similar to the two-dimensional Kagome truss shown at the right of FIG. 1. In such a two-dimensional Kagome truss woven by the wire groups 1, 2 and 3, two wires at each intersection cross each other at an azimuth angle of 60 or 120 degrees. Since respective elements forming the truss substitute for continuous wires, such Kagome truss has a configuration very similar to the ideal Kagome truss except that the wires deviate from the intersection to produce a small curvature.

Figure 7:
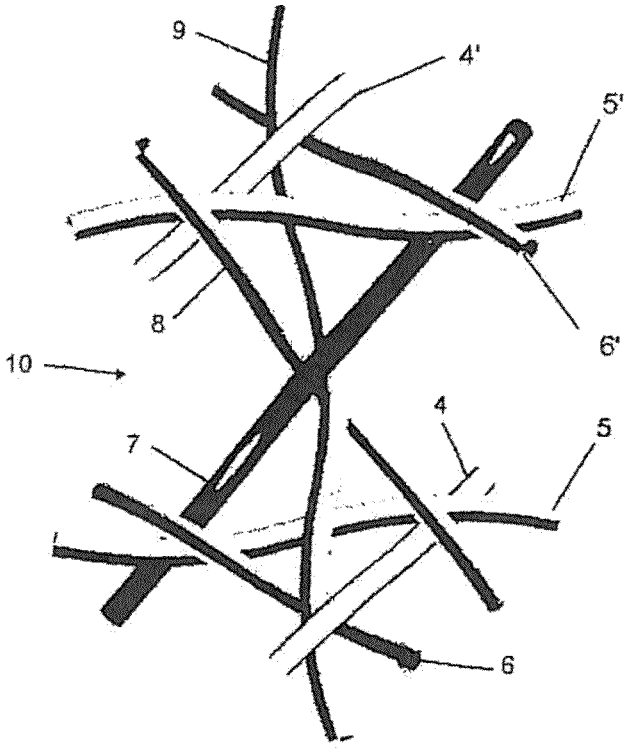

FIG. 7 three-dimensionally illustrates the portion A of FIG. 6. Here, regular triangles opposite to each other are converted into regular tetrahedrons, and three wires other than two wires cross at an intersection at an angle of 60 or 120 degrees with respect to one another. Such a structure is formed by wire groups 4, 5, 6, 7, 8 and 9 arranged to have the same angle in a three-dimensional space.

A unit cell formed by the wire groups 4, 5, 6, 7, 8 and 9 is configured such that two regular tetrahedrons similar to each other are symmetrically opposite to each other at one apex. The structure of such a unit cell will be described as follows.

The wire groups 4, 5 and 6 cross each other in the same plane (x-y plane) to form a regular triangle. Then, the wire group 7 crosses the intersection of the wire group 5 and the wire group 6, the wire group 8 crosses the intersection of the wire group 4 and the wire group 5, and the wire group 9 crosses the intersection of the wire group 6 and the wire group 4. In this case, the wire groups 6, 9 and 7 cross each other to form a regular triangle, the wire groups 4, 8 and 9 cross each other to form a regular triangle, and the wire groups 5, 7 and 9 cross each other to form a regular triangle. Thereby, the wire groups 4, 5, 6, 7, 8 and 9 in the six directions form one regular tetrahedron (a first regular tetrahedron).

Above the x-y plane, respective wires selected from other wire groups 4', 5' and 6' located above the apex (a reference apex) of the first regular tetrahedron formed by crossing the wire groups 7, 8 and 9 and arranged in the same directions as the wire groups 4, 5 and 6 are disposed to cross two wires selected from the wire groups 7, 8 and 9 to form a regular triangle. Thereby, the wire groups 4', 5', 6', 7, 8 and 9 form another regular tetrahedron (a second regular tetrahedron). Accordingly, a unit cell of a three-dimensional porous light-weight structure 10 in which the regular tetrahedron (the first regular tetrahedron) formed by the wire groups 4, 5, 6, 7, 8 and 9 and the regular tetrahedron (the second regular tetrahedron) formed by the wire groups 4', 5', 6', 7, 8 and 9 are opposite to each other with respect to the intersection formed by the wires groups 7, 8 and 9 is formed.

Further, in order to form plural unit cells 10 in each direction of the three-directional space, the wires are arranged to form regular tetrahedrons opposite to each other at the remaining apexes of the regular tetrahedron formed by the wire groups 4, 5, 6, 7, 8 and 9 in the above-described manner. Thereby, a truss-shaped porous light-weight structure in which such unit cells 10 are repeated in the three-dimensional space may be formed.

Figure 3:
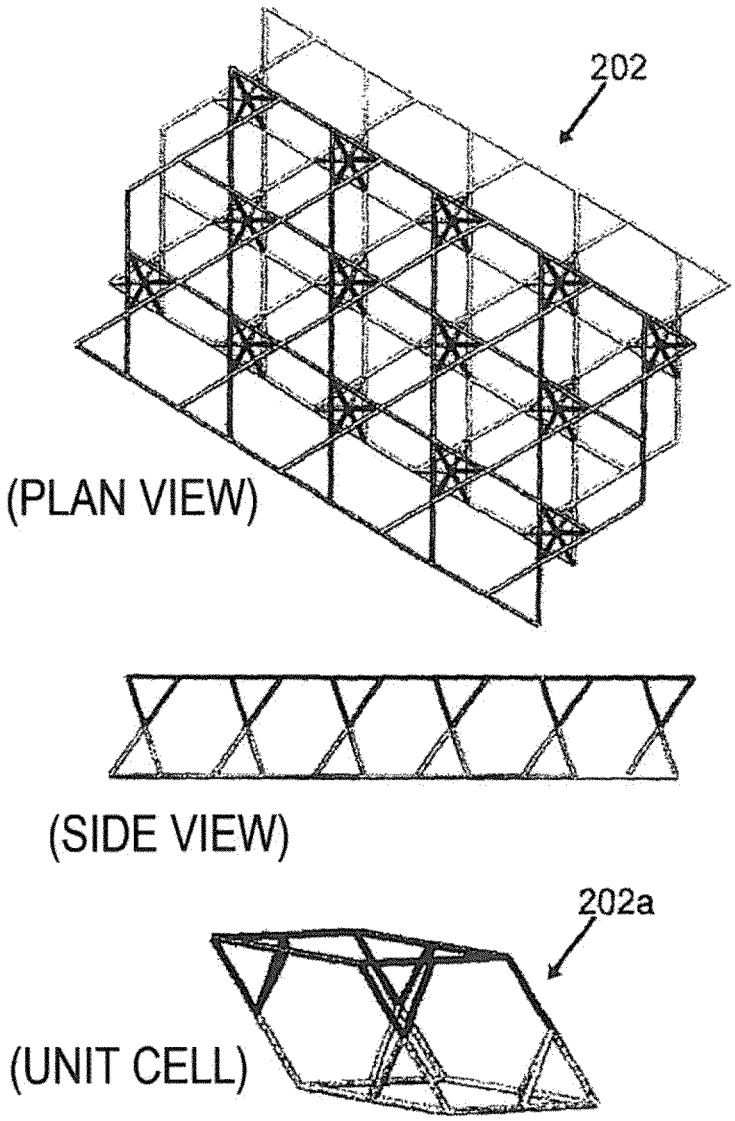
FIG. 3 illustrates plan and side views of one layer of a conventional three-dimensional Kagome truss and a perspective view of a unit cell of the Kagome truss.
Figure 4:
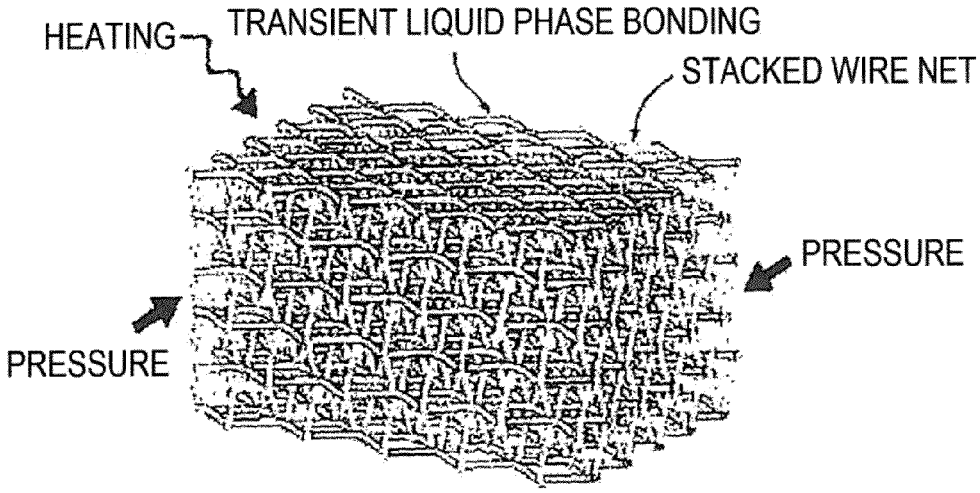
FIG. 4 is a perspective view of a conventional light-weight structure manufactured by stacking wire nets.
Figure 5:
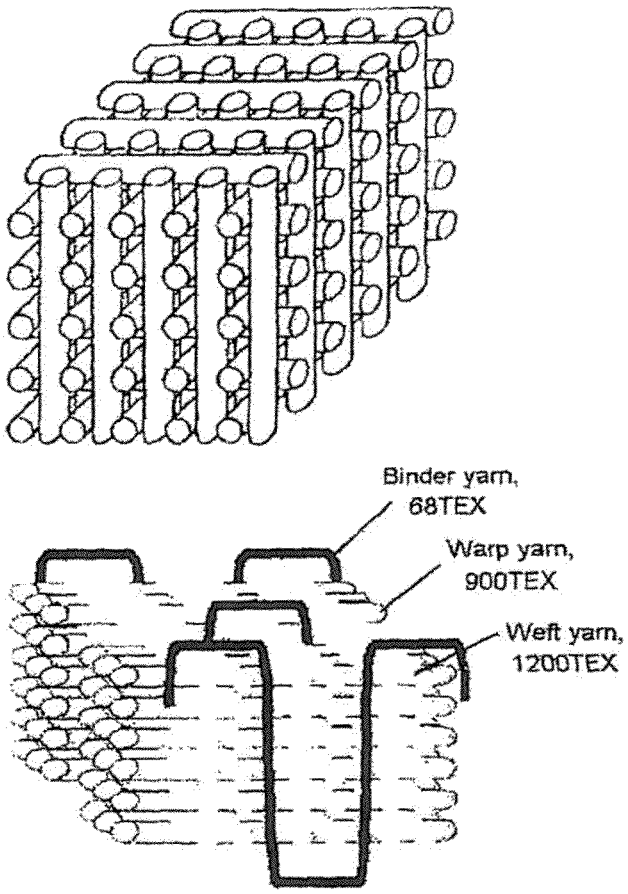
FIG. 5 illustrates perspective and detailed views of a conventional three-dimensional fiber-reinforced composite material woven by fibers.
Figure 8:
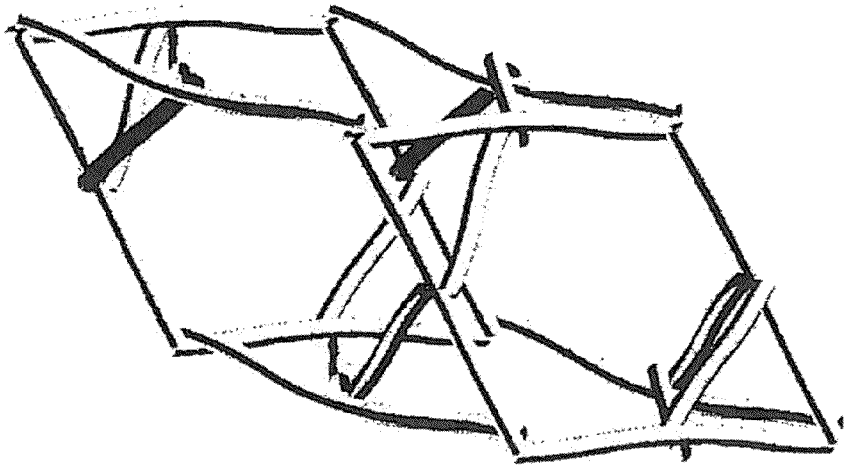

Through the above wire arrangement, a unit cell similar to the unit cell of the three-dimensional Kagome truss of FIG. 3 may be formed by wires in six directions, and FIG. 8 illustrates such a unit cell.

Figure 9:
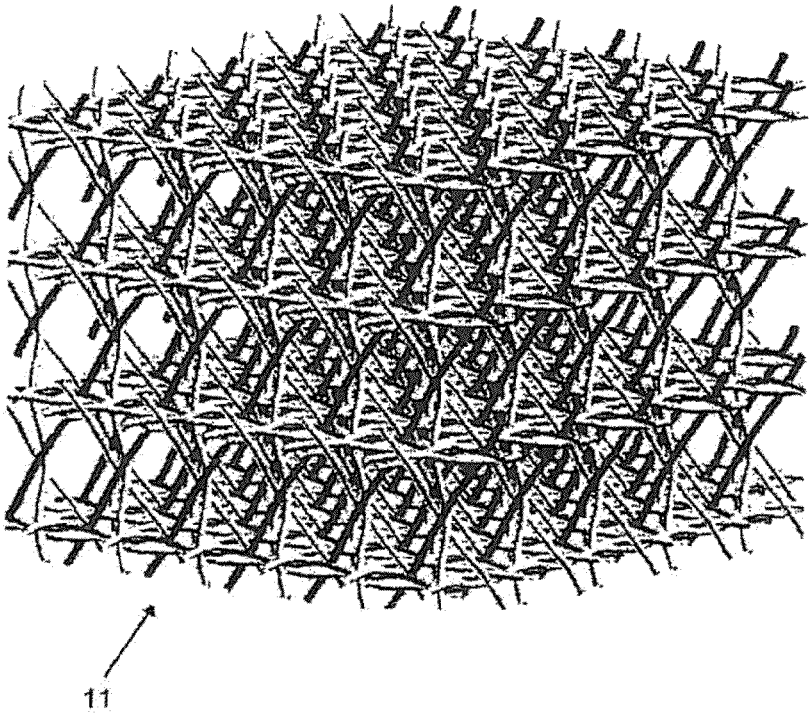

FIG. 9 illustrates a three-dimensional Kagome truss assembly using wires formed by the above method, i.e., illustrates a three-dimensional truss-shaped porous light-weight structure 11 in which the unit cell of FIG. 7 or 8 is repeated.

Figure 10:
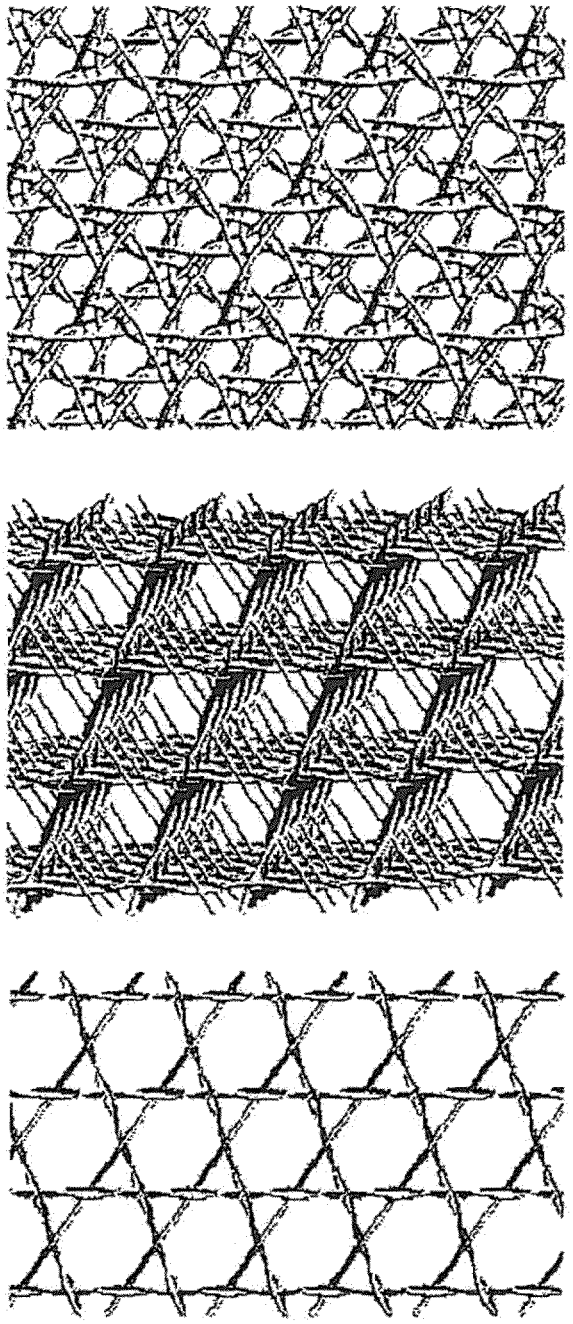

As shown in FIG. 10, such a Kagome truss-shaped three-dimensional porous light-weight structure 10 may have various shapes according to viewing directions of the structure 10. Particularly, the lowermost view of FIG. 10 illustrates a shape of the Kagome truss-shaped three-dimensional porous light-weight structure 10 very similar to the two-dimensional Kagome truss of FIG. 6, as seen from one wire group of the wire groups in the six directions. That is, the three-dimensional porous light-weight structure 11 is seen as if it has the same shape, as seen in the axial directions of the six wires having the same angle (60 or 120 degrees) in the three-dimensional space.

Figure 11:
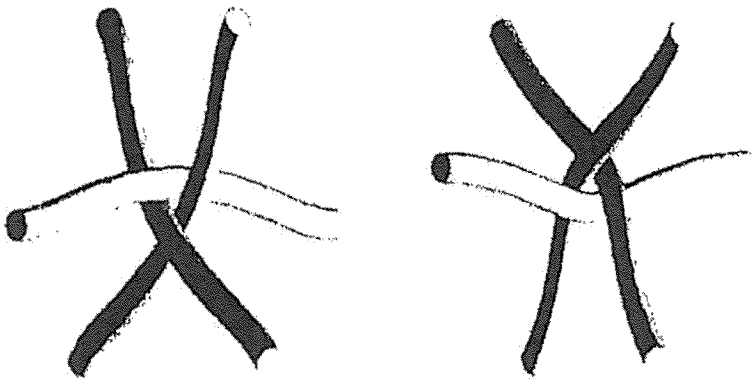

All intersections at which three wires cross correspond to the apexes of the regular tetrahedron, and as seen from the front of the apexes, the wires cross by two methods, as shown in FIG. 11. In the first method, three wires cross one another so as to overlap one another in the clockwise direction, as shown in the first view, and in the second method, three wires cross one another so as to overlap one another in the counterclockwise direction, as shown in the second view.

Figure 12:
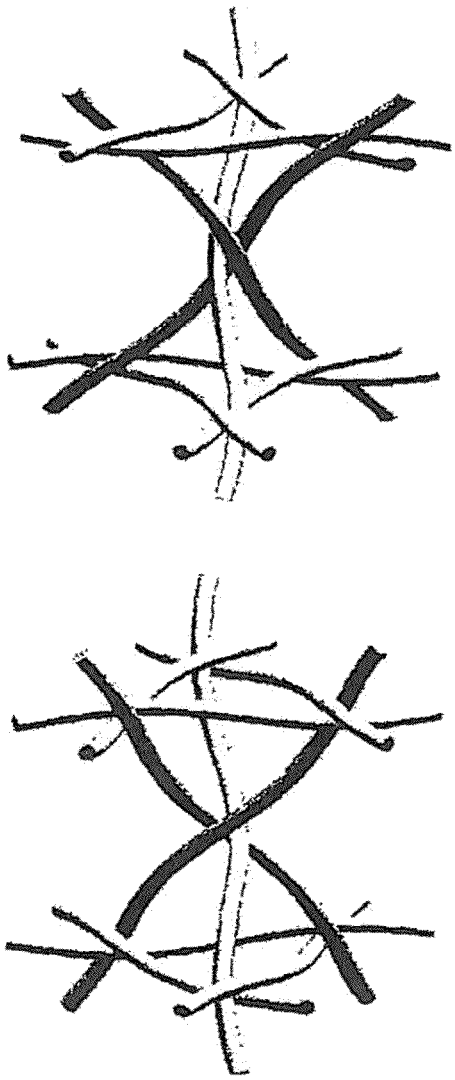

When the wires cross one another so as to overlap one another in the clockwise direction, regular tetrahedron forming the unit cell have a slim shape, as shown in the first view of FIG. 12, and when the wires cross one another so as to overlap one another in the counterclockwise direction, regular tetrahedron forming the unit cell have a plump shape, as shown in the second view of FIG. 12. However, in any case, a porous light-weight structure similar to the ideal Kagome truss or an Octet truss which will be described later may be obtained.

Hereafter, a manufacturing method of such a three-dimensional porous light-weight structure will be described.

First, the first to third wires 4, 5 and 6 cross so as to form a regular triangle in the same plane, the fourth wire 7 crosses the intersection of the second wire and the third wire 6, the fifth wire 8 crosses the intersection of the first wire 4 and the second wire 5, the sixth wire 9 crosses the intersection of the third wire 6 and the first wire 4, and the fourth to sixth wires 7, 8 and 9 cross one reference intersection, thereby forming the first regular tetrahedron.

Then, the wires 4', 5' and 6' parallel with the first wire 4, the second wire 5 and the third wire 6 respectively cross two wires selected from the fourth wire 7, the fifth wire 8 and the sixth wire 9 passing through the reference intersection and extending, thereby forming the second regular tetrahedron similar to the first regular tetrahedron and contacting the first regular tetrahedron at the reference intersection.

Thereafter, the unit cell formed by the first regular tetrahedron and the second regular tetrahedron is repeated in the three-dimensional space, thereby forming the truss-shaped structure.

In this case, the first regular tetrahedron and the second tetrahedron are similar to each other. If a ratio of similarity of the first regular tetrahedron to the second tetrahedron is 1:1, a structure similar to the Kagome truss is formed, and if a ratio of similarity of the first regular tetrahedron to the second tetrahedron is greater than 1:1, a structure similar to the Octet truss is formed, as described above.

Hereinafter, a three-dimensional lattice truss structure composed of helical wires and manufacturing method thereof in accordance with the present invention and will be described.

First, ideal shapes of similar truss structures which are to be formed using helical wires in accordance with the present invention will be described.

Figure 13:
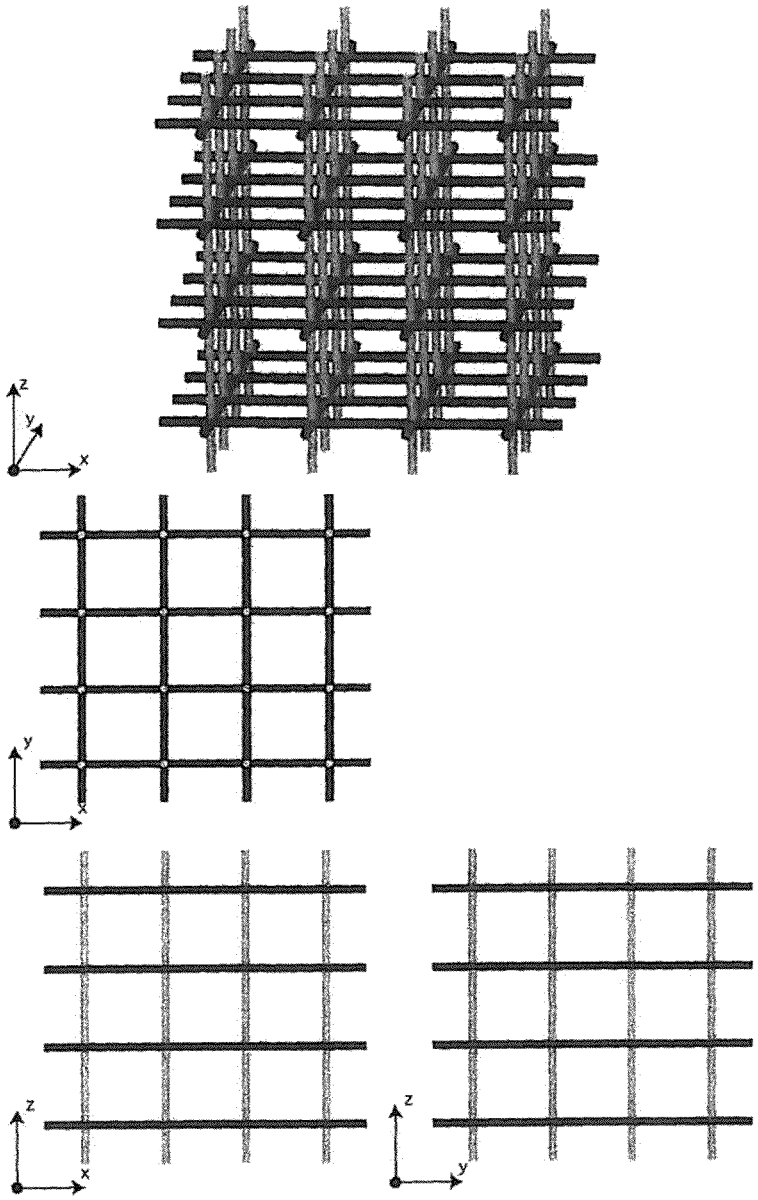
FIGS. 13 to 17 illustrate ideal shapes of similar truss structures to be formed using helical wires in accordance with the present invention, in more detail.
Figure 14:
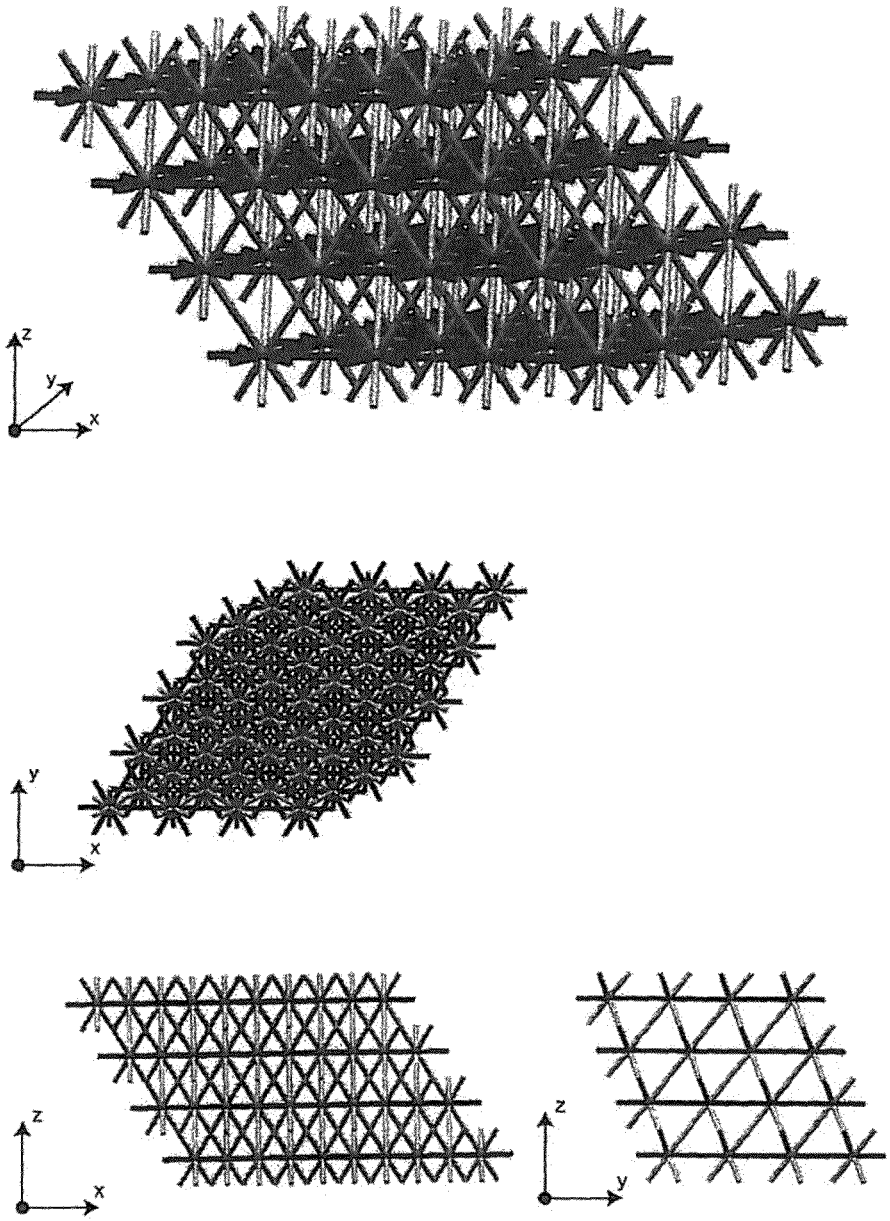
Figure 15:
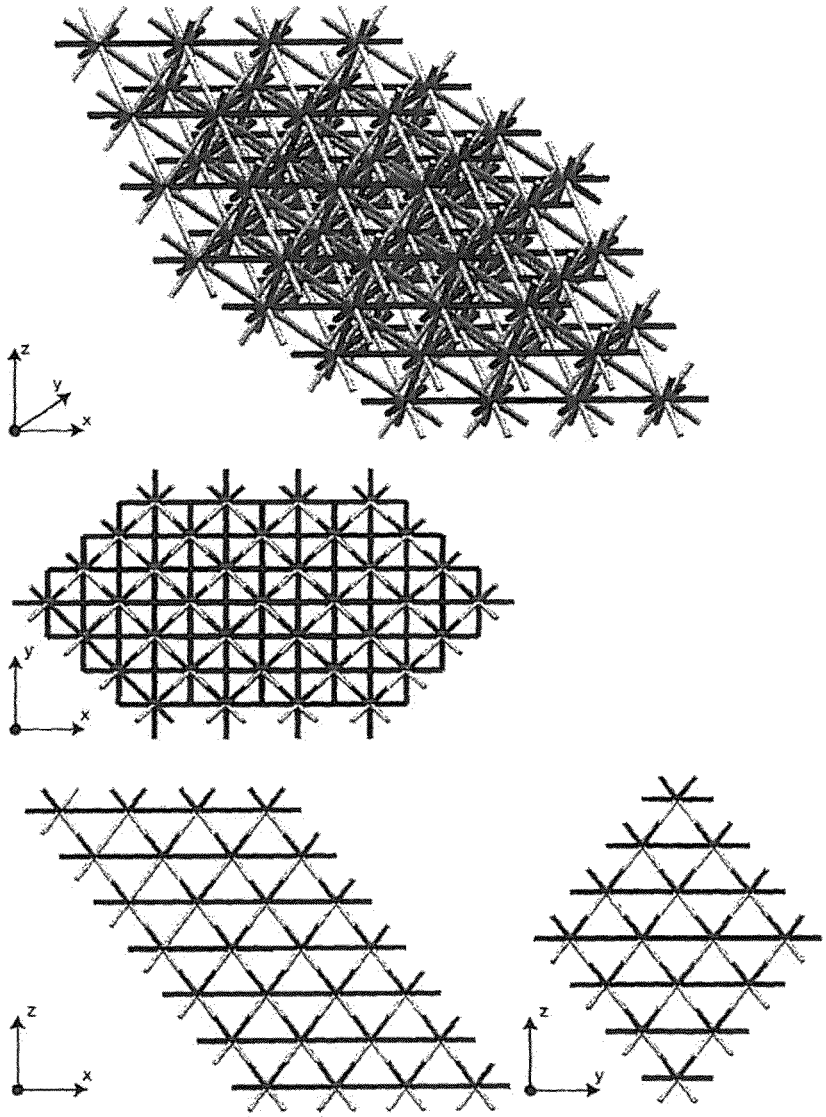
Figure 16:
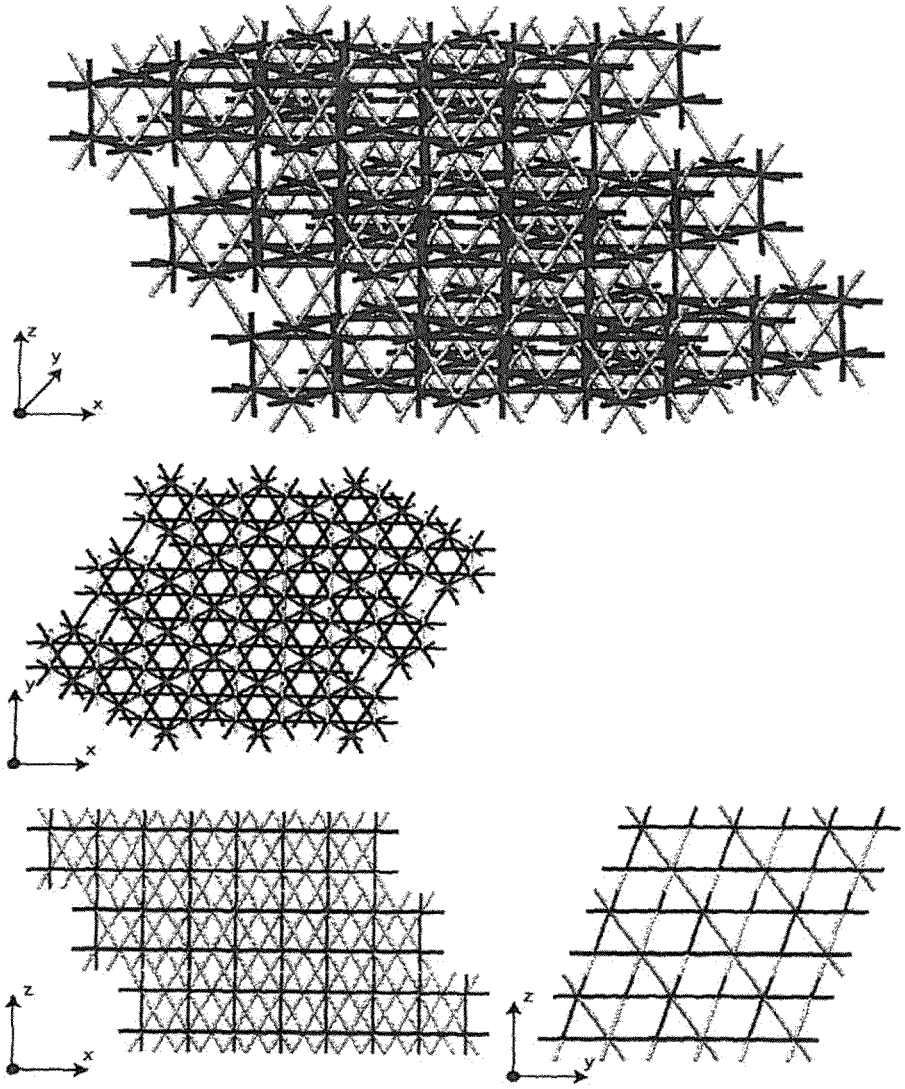
Figure 17:
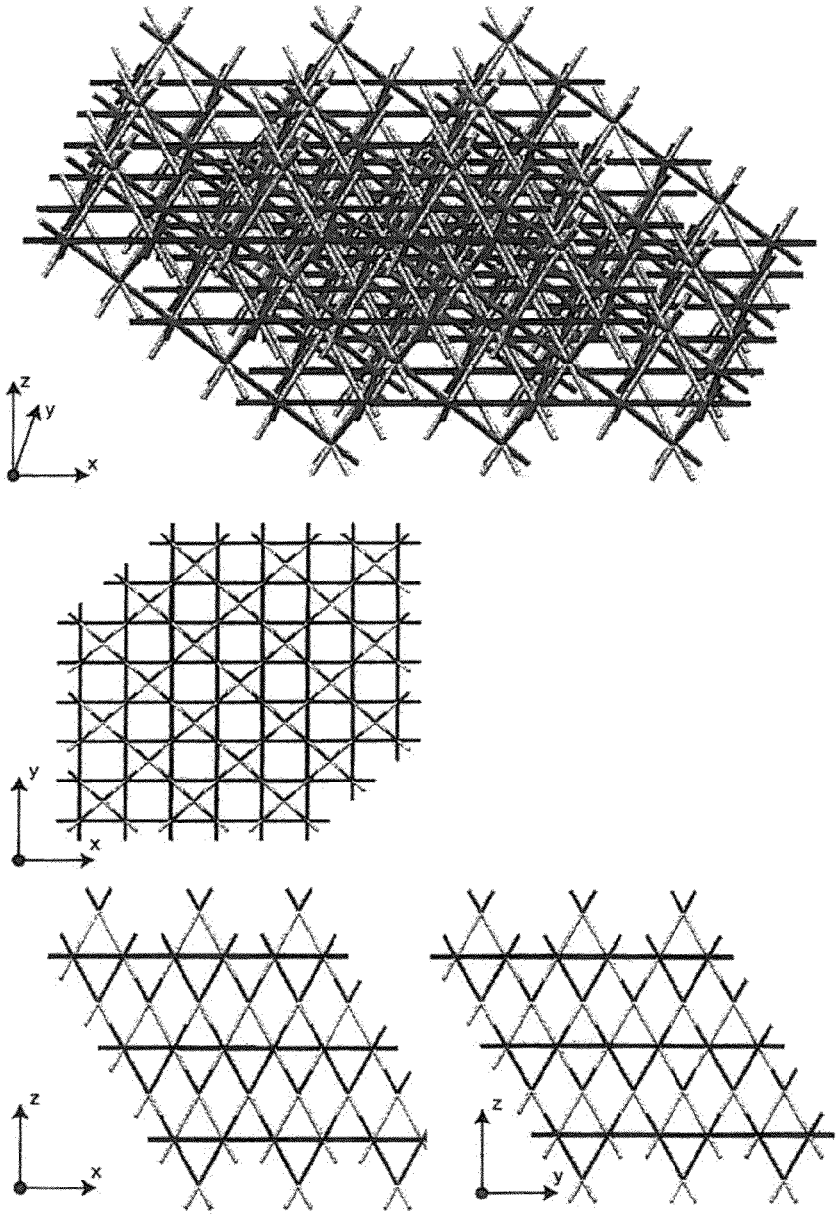

FIG. 13 illustrates a shape of a hexahedron truss. FIG. 14 illustrates a shape in which plural layers of an Octet truss are arranged. FIG. 15 illustrates the Octet truss of FIG. 14 rotated such that a regular tetragonal net-shaped plane is parallel with the x-y plane. FIG. 16 illustrates a multi-layer truss structure composed of plural regular octahedrons and cuboctahedrons (or vector equilibriums) (Buckminster Fuller, Synergetics: explorations in the geometry of thinking, Macmillan Publishing Co., 1975, pp. 669), and FIG. 17 illustrates the truss structure rotated such that a regular tetragonal net-shaped plane is parallel with the x-y plane.

FIGS. 18 to 22 are views illustrating examples of the multi-layer truss structures of FIGS. 13 to 17 which are woven by helical wires. Hereinafter, processes of assembling the structures of FIGS. 18 to 22 using helical wires will be described.

Figure 18:
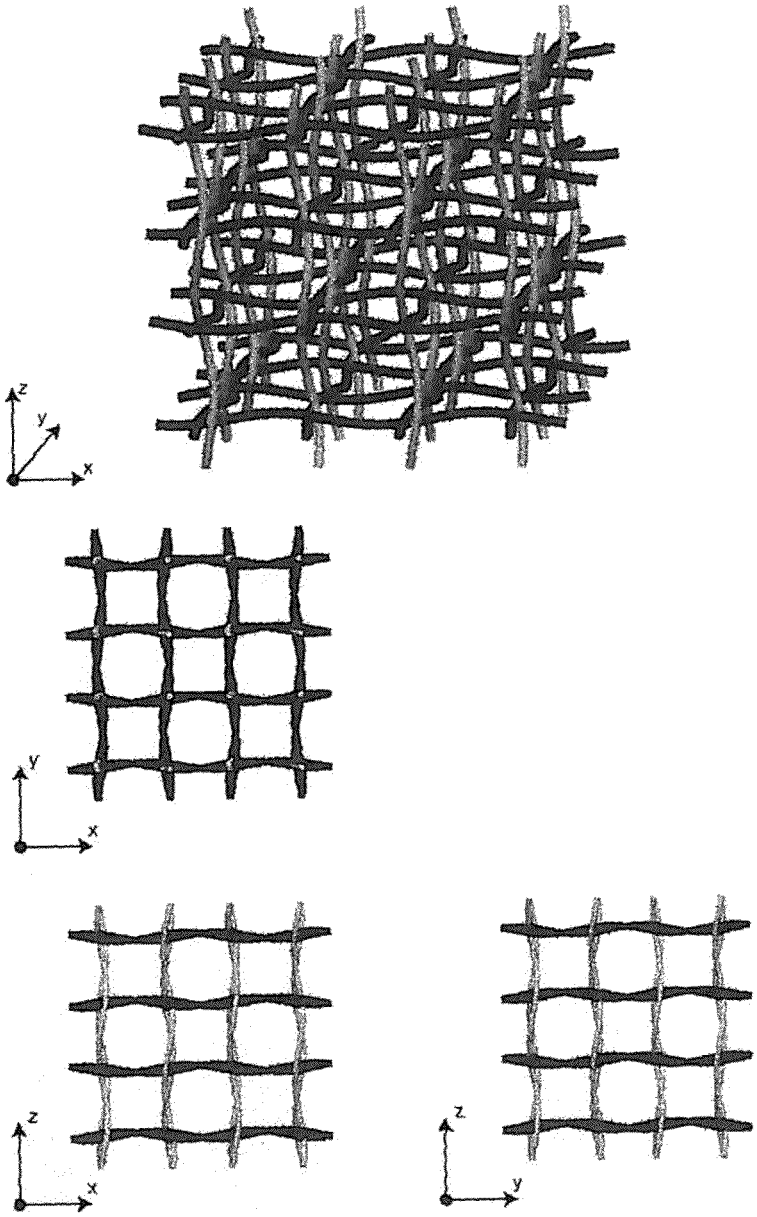
FIGS. 18 to 22 are views illustrating examples of the multi-layer truss structures of FIGS. 13 to 17 which are woven by helical wires.
Figure 23:
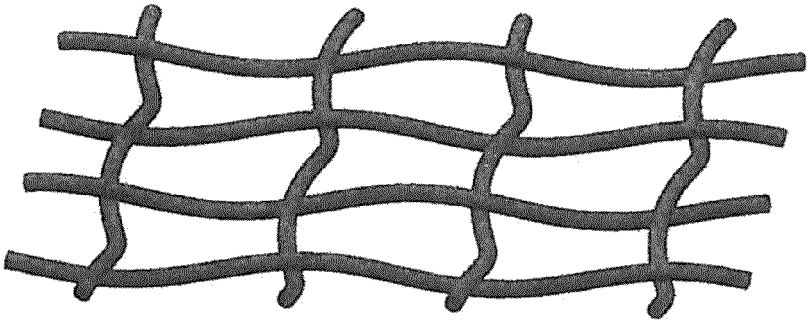
FIGS. 23 to 25 are views illustrating a process of assembling the structure of FIG. 18.
Figure 24:
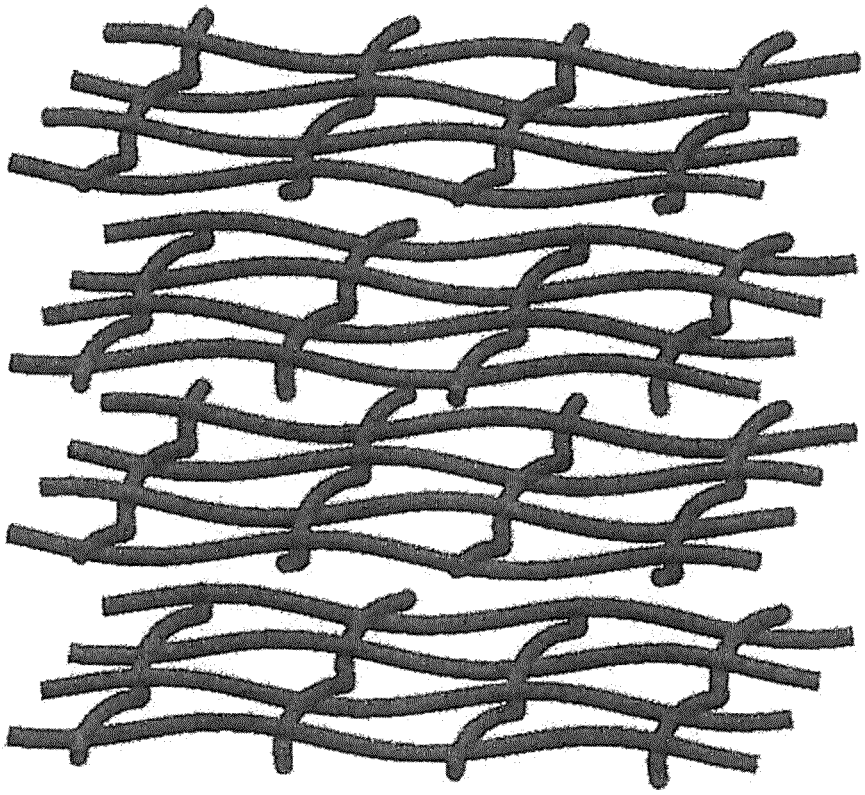
Figure 25:
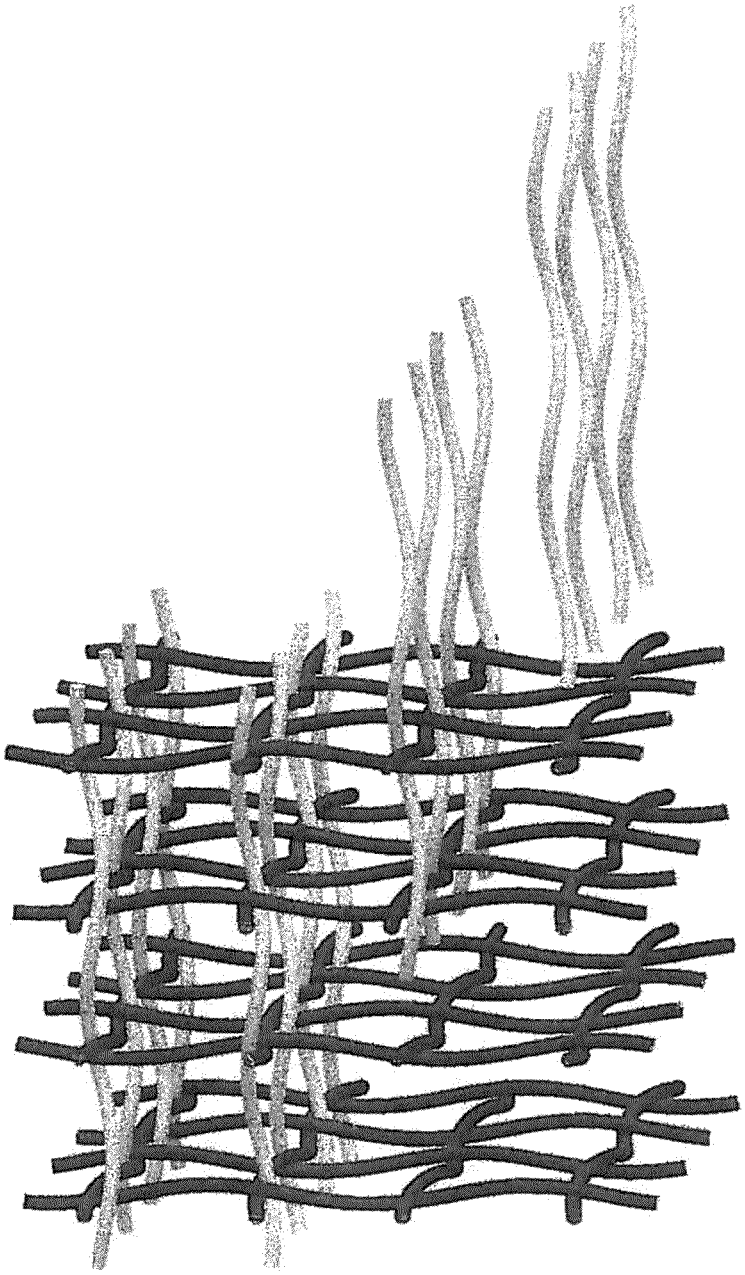

FIGS. 23 to 25 are views illustrating a process of assembling the structure of FIG. 18.

First, FIG. 23 illustrates a net-shaped plane having rectangular meshes which is assembled using plural helical wires disposed in parallel and arranged in two axial directions on one plane at an azimuth angle of 90 degrees with respect to each other. FIG. 24 illustrates a plurality of the above net-shaped planes arranged at a designated interval in parallel with the x-y plane. FIG. 25 illustrates partial insertion of helical wires in one axial direction arranged out-of-plane and having an azimuth angle of 90 degrees with respect to the helical wires in the two axial directions into the intersections of the helical wires in the two axial directions arranged in-plane in FIG. 24.

Figure 19:
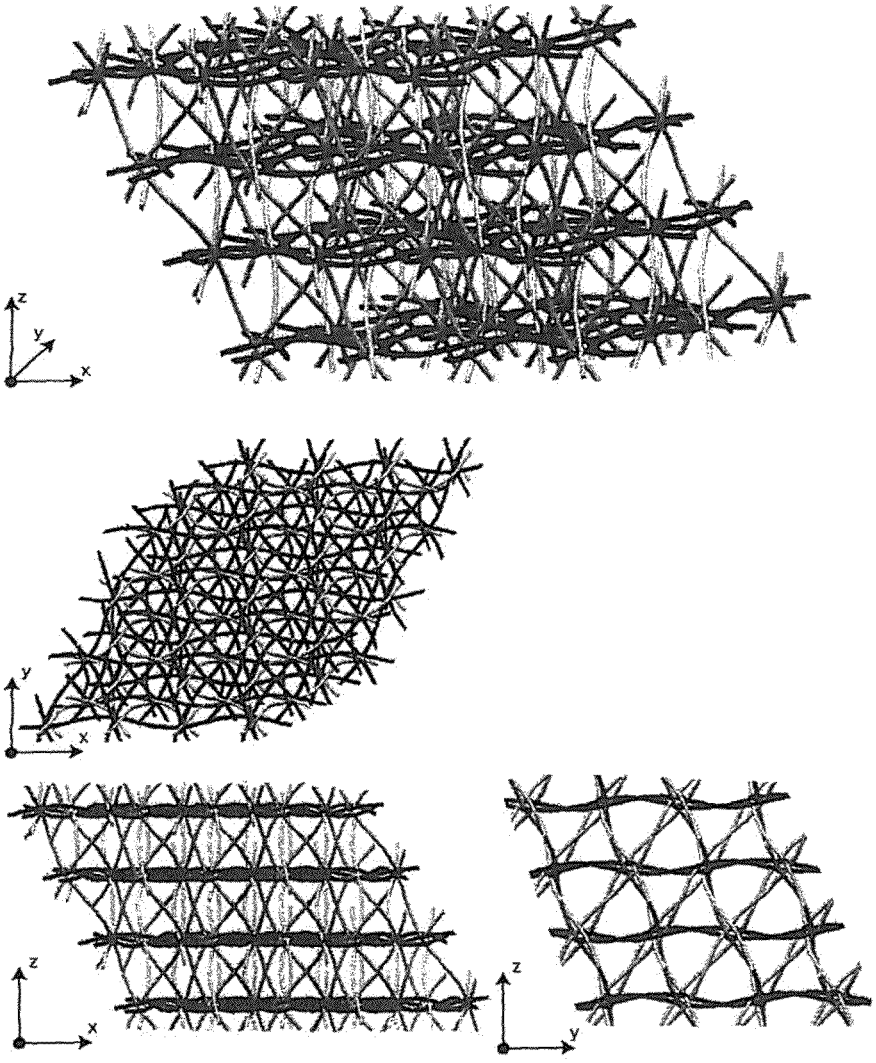
Figure 26:
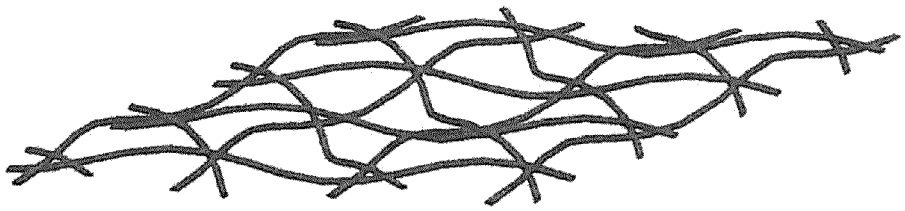
FIGS. 26 to 30 are views illustrating a process of assembling the structure of FIG. 19.
Figure 27:
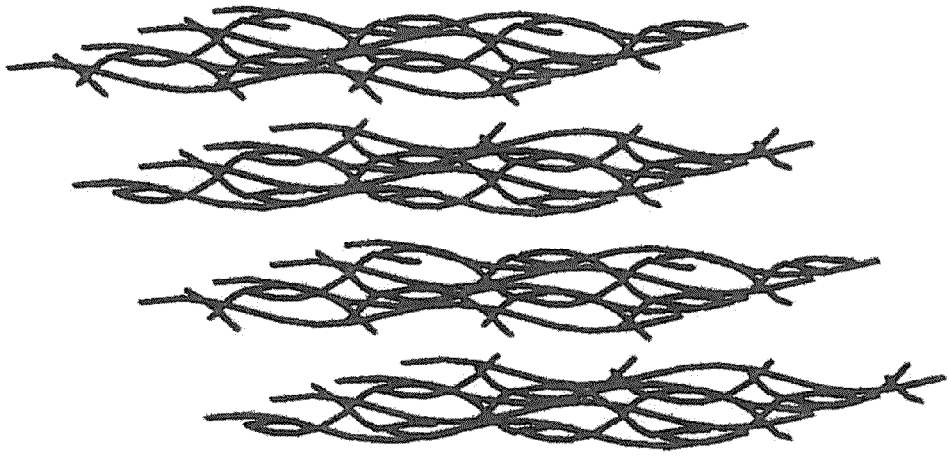
Figure 28:
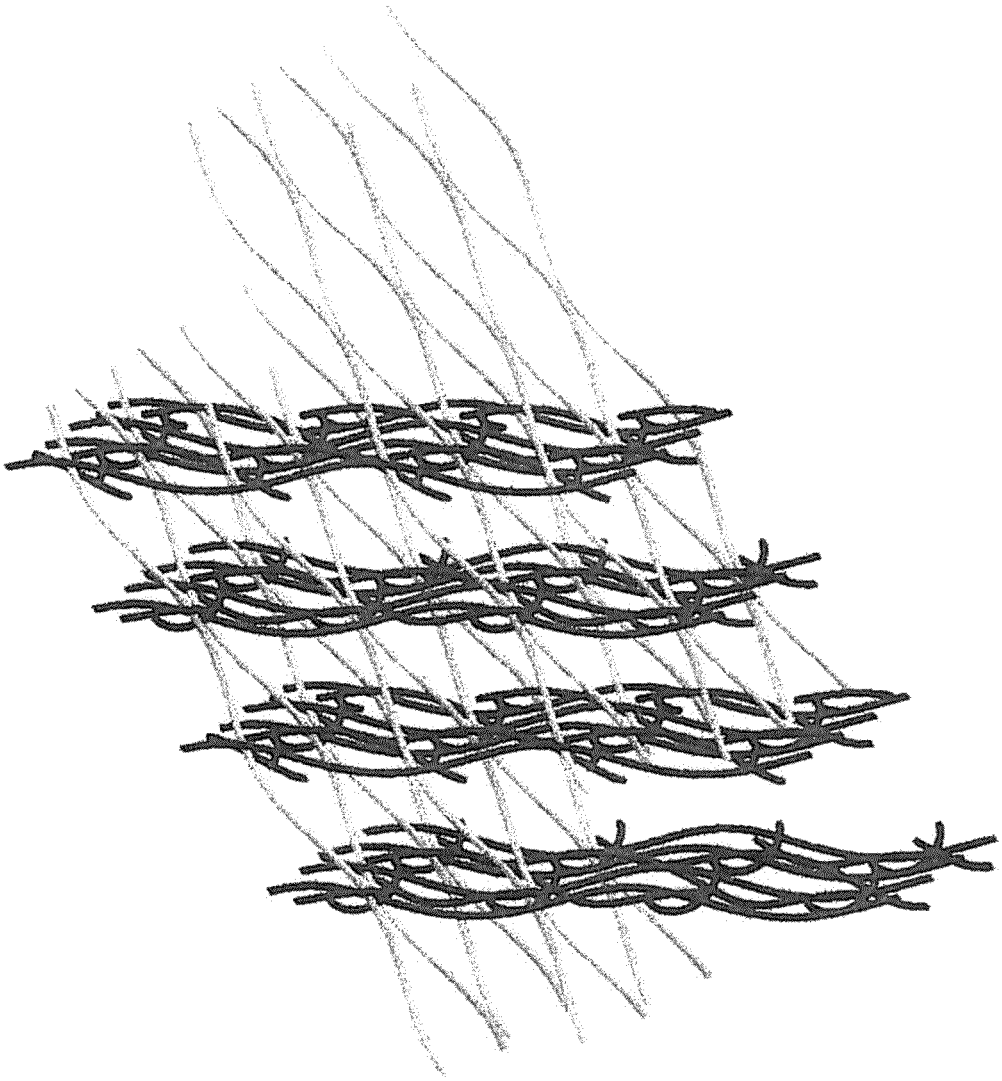
Figure 29:
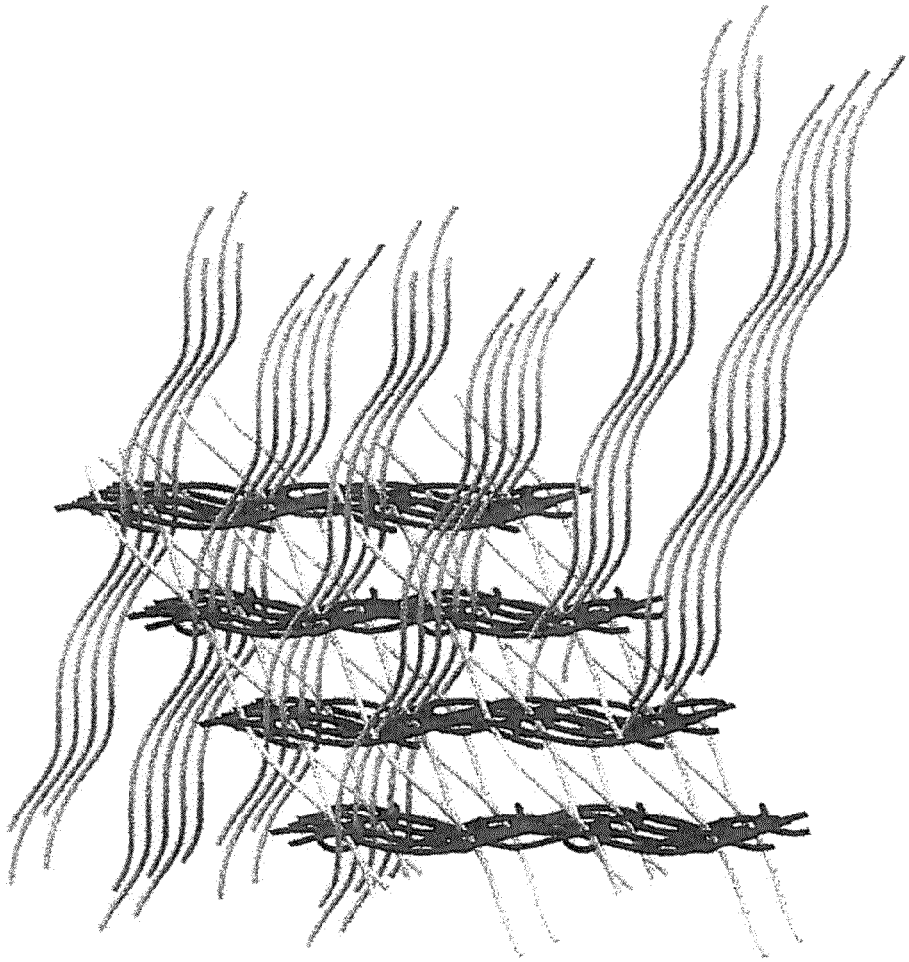
Figure 30:
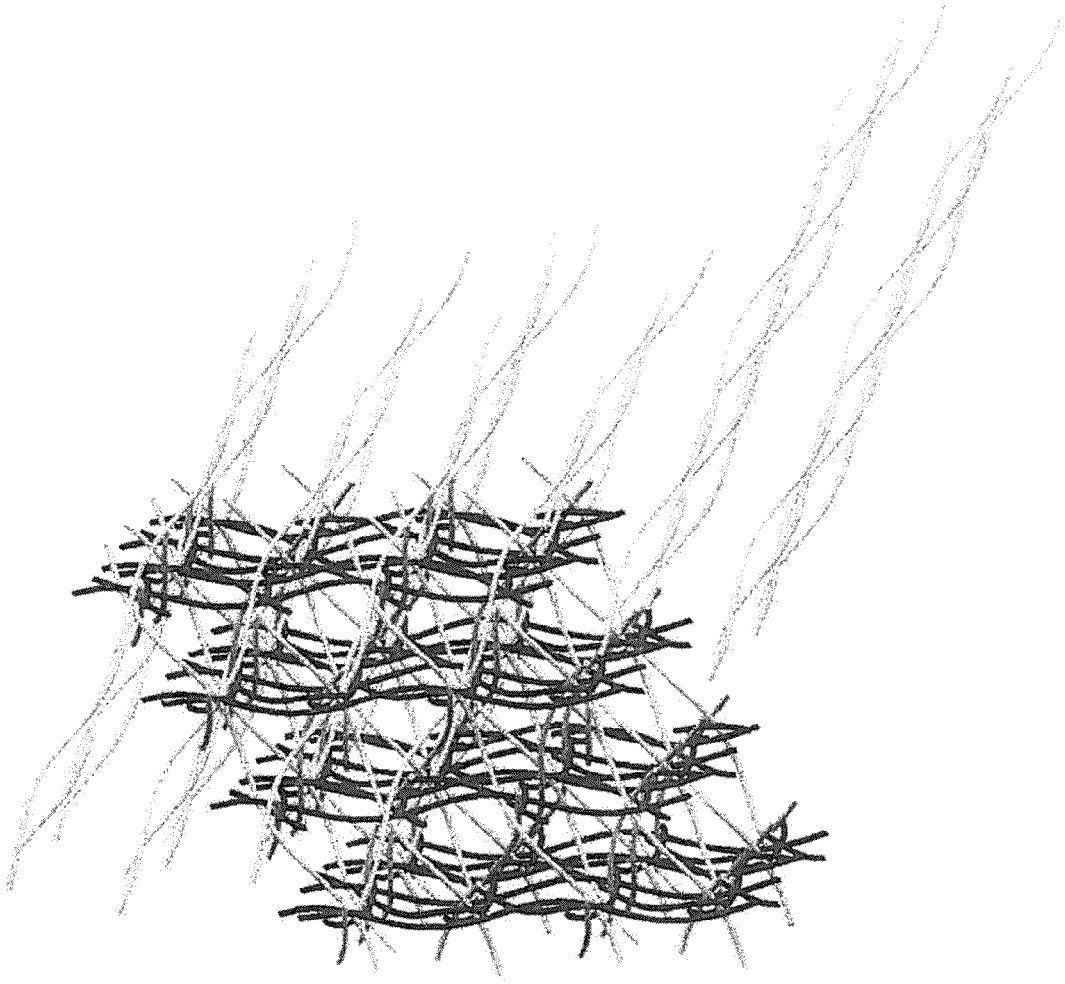

FIGS. 26 to 30 are views illustrating a process of assembling the structure of FIG. 19. First, FIG. 26 illustrates a net-shaped plane having triangular meshes which is assembled using plural helical wires disposed in parallel and arranged in three axial directions on one plane at an azimuth angle of 60 degrees with respect to one another. FIG. 27 illustrates a plurality of the above net-shaped planes arranged at a designated interval in parallel with the x-y plane. FIG. 28 illustrates an inserted or inserting state of helical wires in one axial direction arranged out-of-plane and having an azimuth angle of 60 or 90 degrees with respect to the helical wires in the three axial directions and an azimuth angle of 54.7 degrees ($=\cos^{-1}(1\sqrt{3})$) with the x-y plane into the intersections of the helical wires in the three axial directions arranged in-plane in FIG. 27. FIG. 29 illustrates an inserted or inserting state of helical wires in another axial direction arranged out-of-plane and having an azimuth angle of 60 or 90 degrees with respect to the helical wires in the four axial directions arranged in advance and an azimuth angle of 54.7 degrees ($=\cos^{-1}(1\sqrt{3})$) with the x-y plane into the intersections of the helical wires in the three axial directions arranged in-plane, after insertion of the helical wires of FIG. 28 has been completed. FIG. 30 illustrates an inserted or inserting state of helical wires in the remaining one axial direction arranged out-of-plane and having an azimuth angle of 60 or 90 degrees with respect to the helical wires in the five axial directions arranged in advance and an azimuth angle of 54.7 degrees ($=\cos^{-1}(1\sqrt{3})$) with the x-y plane into the intersections of the helical wires in the three axial directions arranged in-plane, after insertion of the helical wires of FIG. 29 has been completed.

Figure 20:
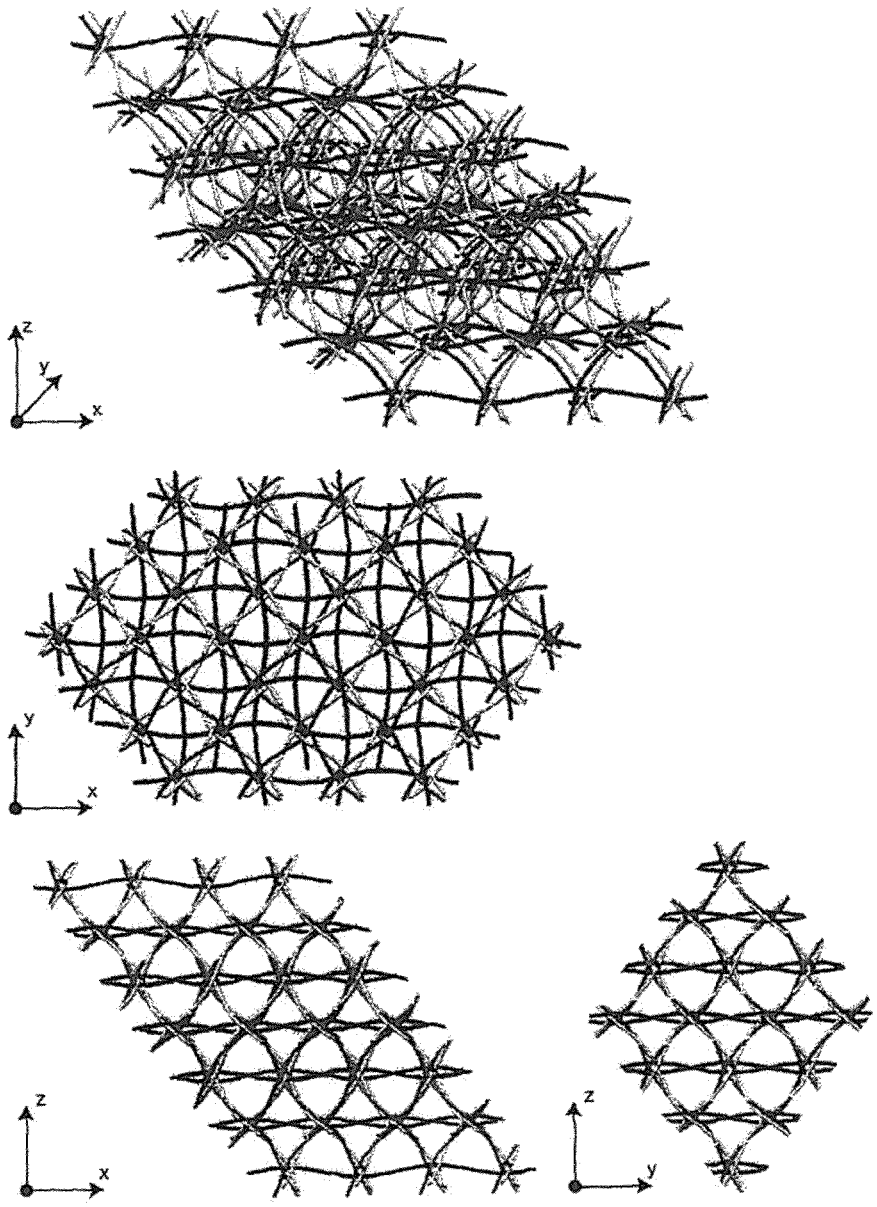
Figure 31:
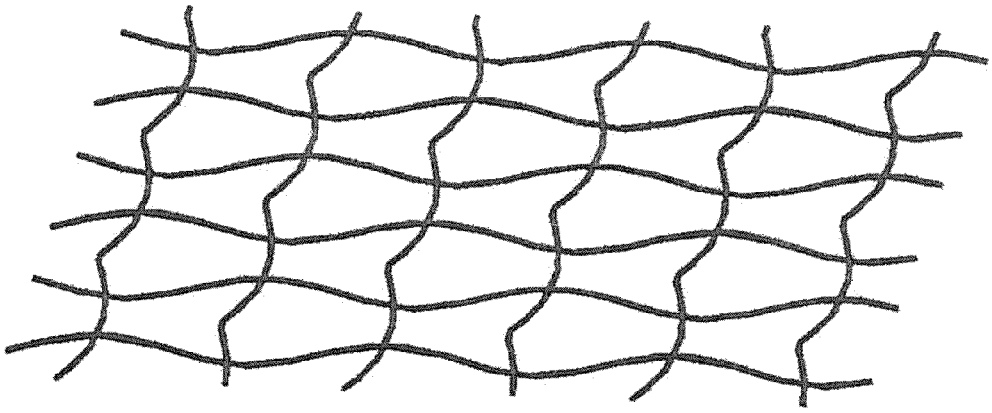
FIGS. 31 to 36 are views illustrating a process of assembling the structure of FIG. 20.
Figure 32:
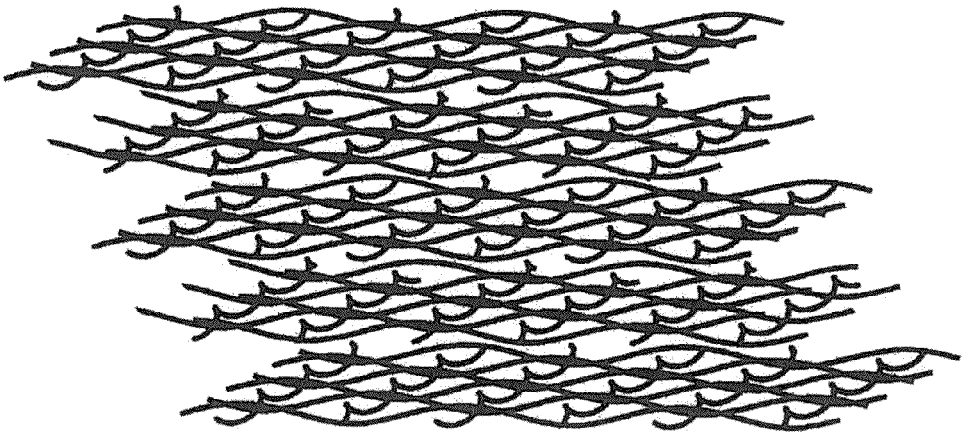
Figure 33:
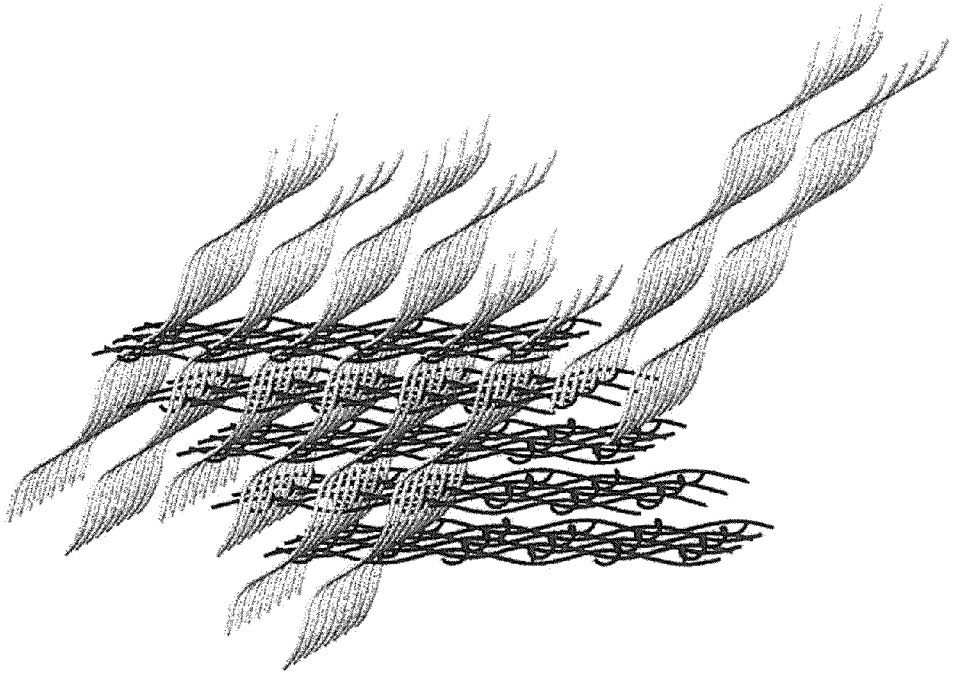
Figure 34:
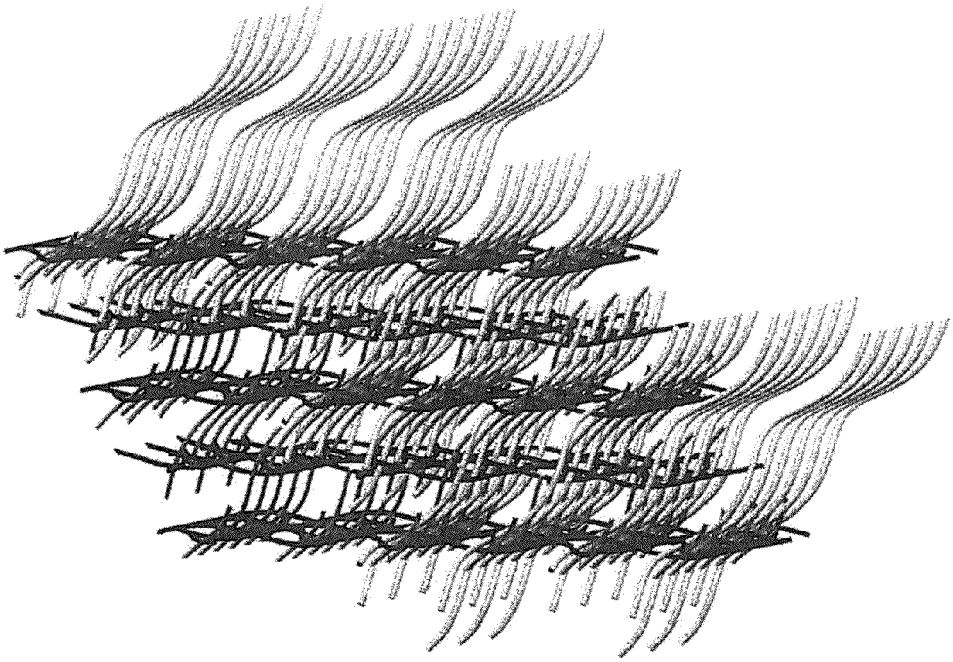
Figure 35:
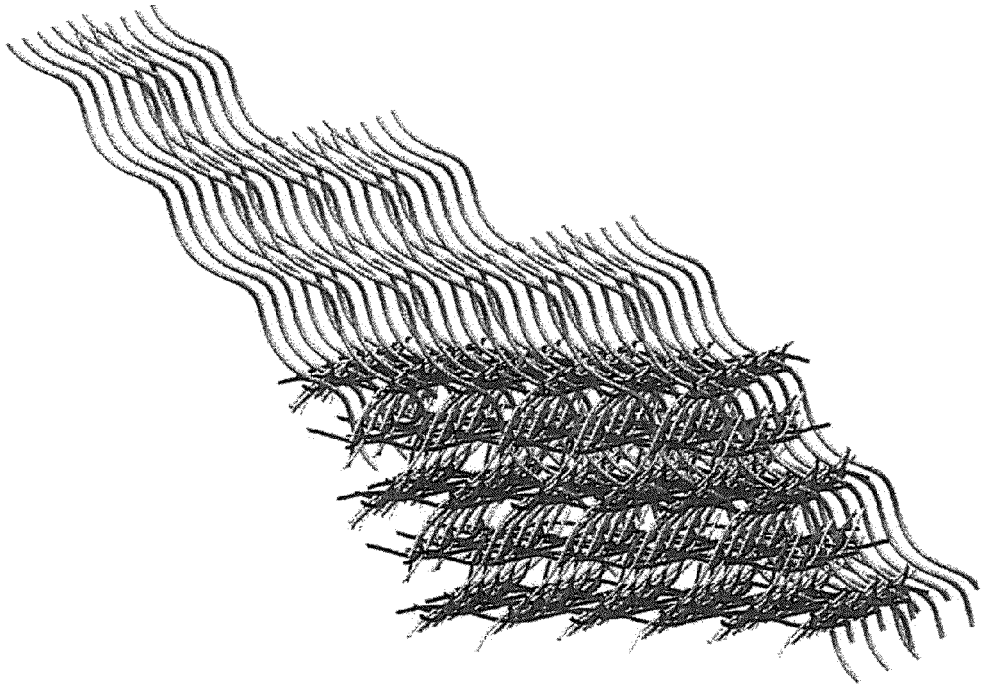
Figure 36:
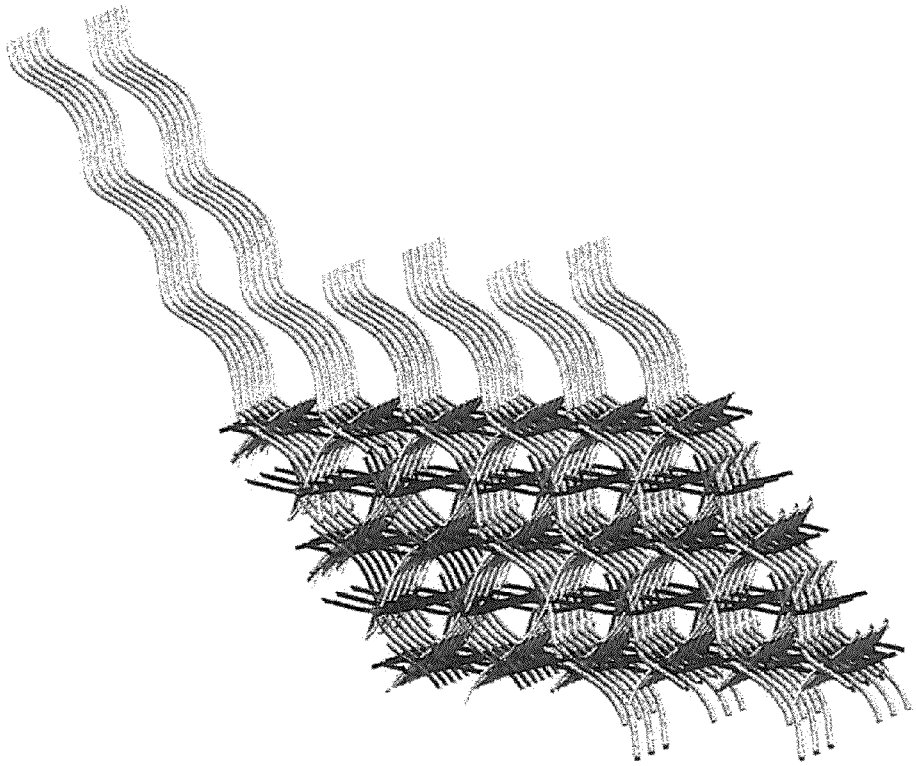

FIGS. 31 to 36 are views illustrating a process of assembling the structure of FIG. 20. First, FIG. 31 illustrates a net-shaped plane having rectangular meshes which is assembled using plural helical wires disposed in parallel and arranged in first and second axial directions on one plane at an azimuth angle of 90 degrees with respect to each other. FIG. 32 illustrates a plurality of the above net-shaped planes arranged at a designated interval in parallel with the x-y plane. FIG. 33 illustrates an inserted or inserting state of helical wires in one axial direction arranged out-of-plane and having an azimuth angle of 60 degrees with respect to the helical wires in the two axial directions and an azimuth angle of 45 degrees with respect to the x-y plane into the intersections of the helical wires in the two axial directions arranged in-plane in FIG. 32. FIG. 34 illustrates an inserted or inserting state of helical wires in another axial direction arranged out-of-plane and having an azimuth angle of 60 or 90 degrees with respect to the helical wires in the three axial directions arranged in advance and an azimuth angle of 45 degrees with respect to the x-y plane into the intersections of the helical wires in the two axial directions arranged in-plane, after insertion of the helical wires of FIG. 33 has been completed. FIG. 35 illustrates an inserted or inserting state of helical wires in another axial direction arranged out-of-plane and having an azimuth angle of 60 or 90 degrees with respect to the helical wires in the four directions arranged in advance and an azimuth angle of 45 degrees with respect to the x-y plane into the intersections of the helical wires in the two axial directions arranged in-plane, after insertion of the helical wires of FIG. 34 has been completed. FIG. 36 illustrates an inserted or inserting state of helical wires in the remaining one axial direction arranged out-of-plane and having an azimuth angle of 60 or 90 degrees with respect to the helical wires in the five directions arranged in advance and an azimuth angle of 45 degrees with respect to the x-y plane into the intersections of the helical wires in the two axial directions arranged in-plane, after insertion of the helical wires of FIG. 35 has been completed.

Figure 21:
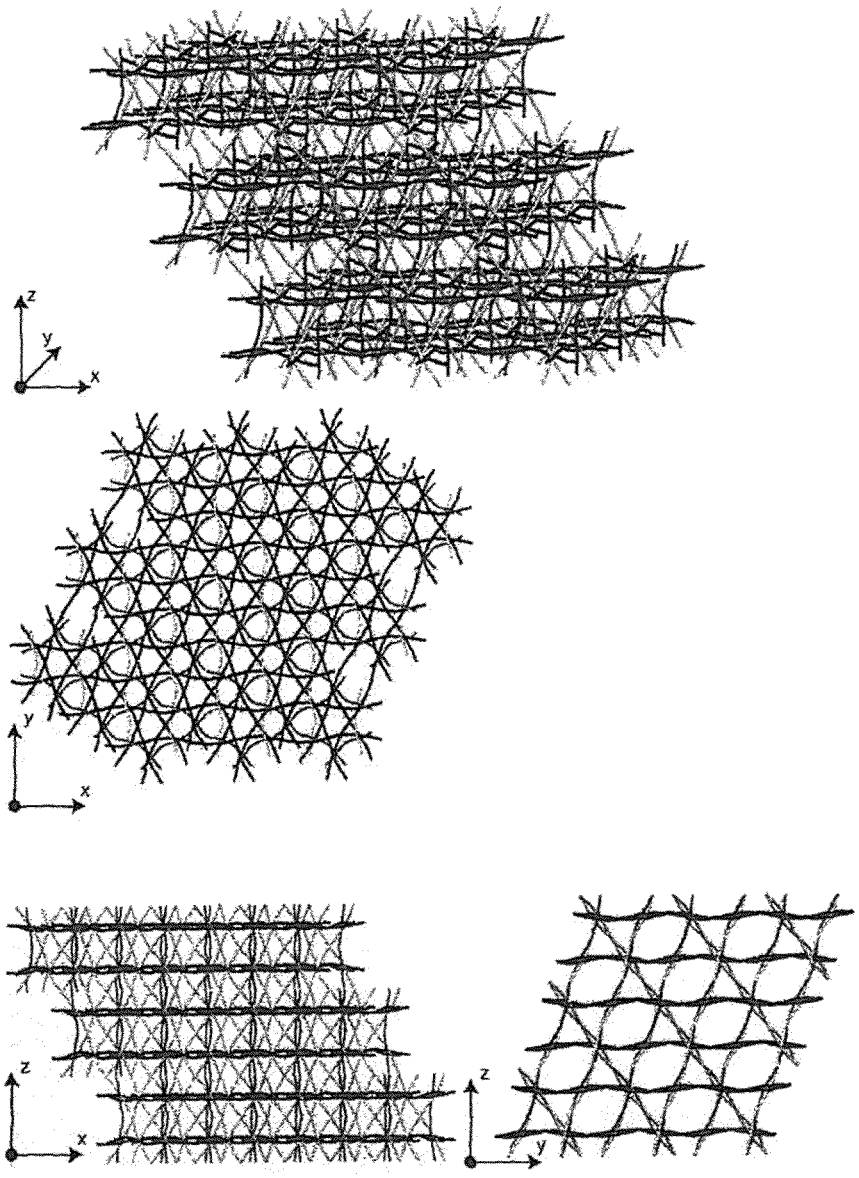
Figure 37:
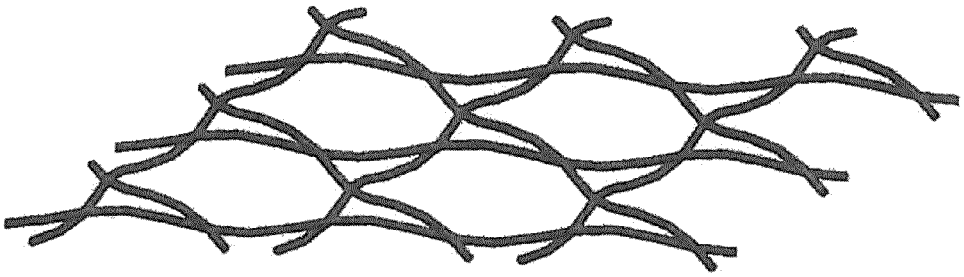
FIGS. 37 to 41 are views illustrating a process of assembling the structure of FIG. 21.
Figure 38:
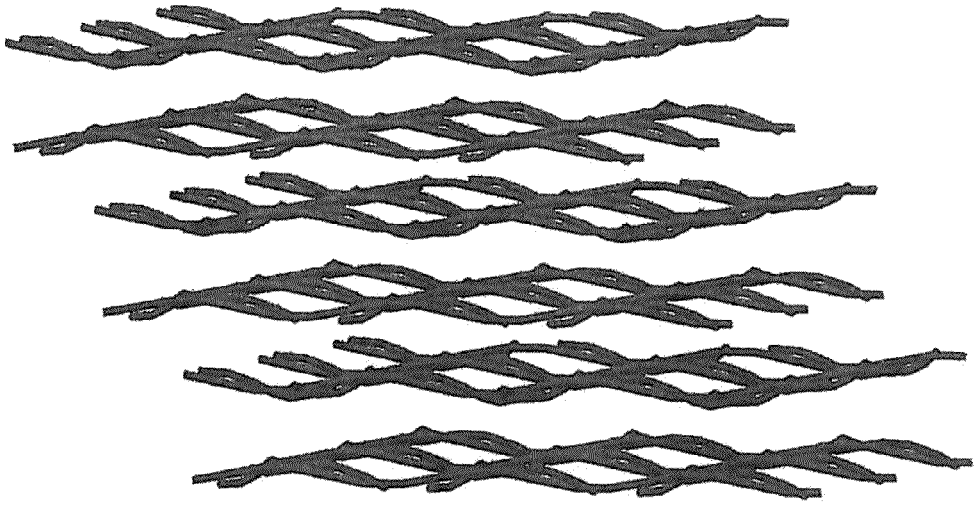
Figure 39:
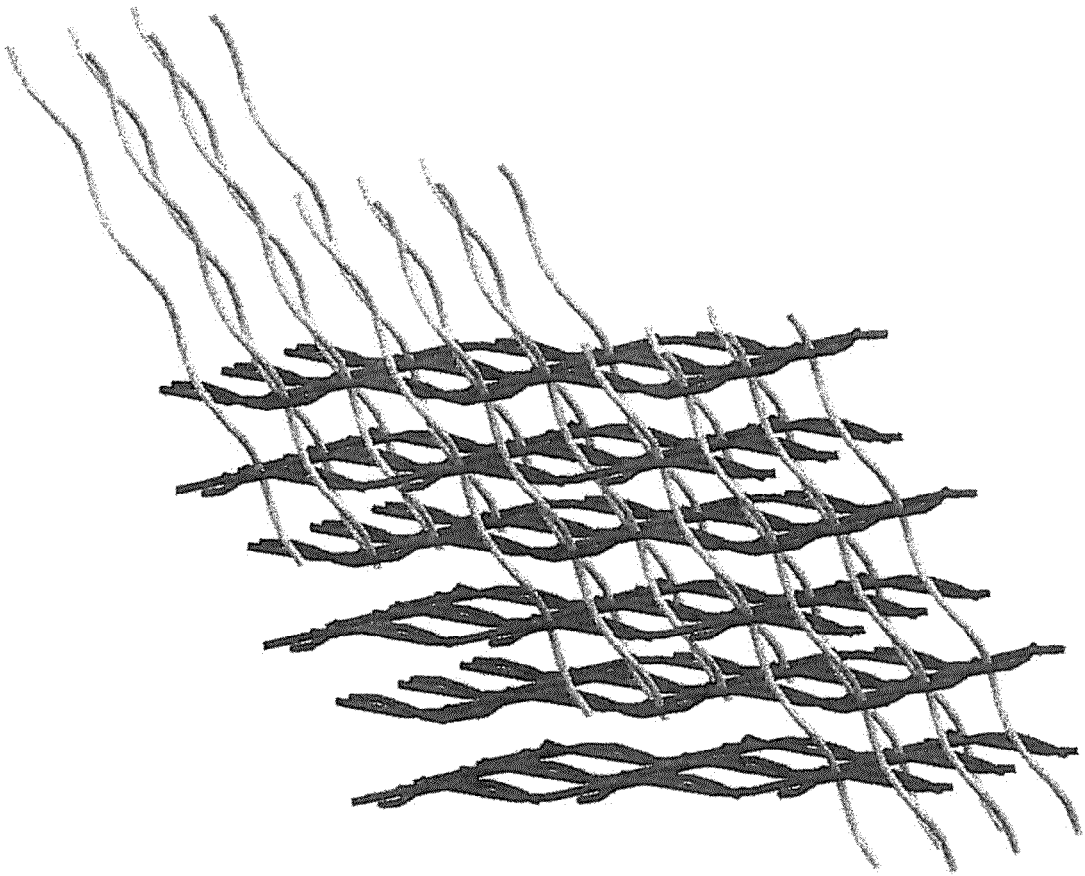
Figure 40:
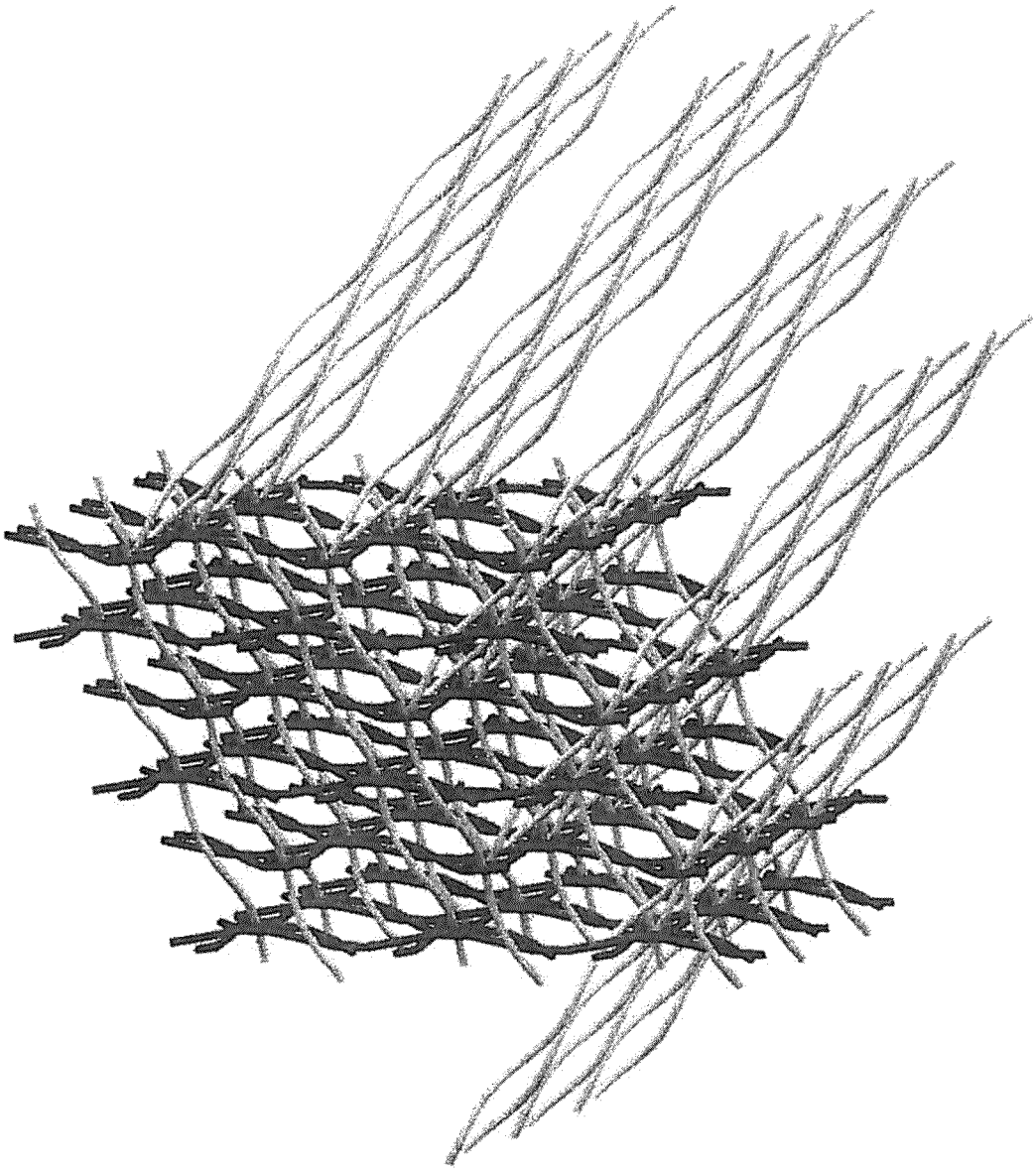
Figure 41:
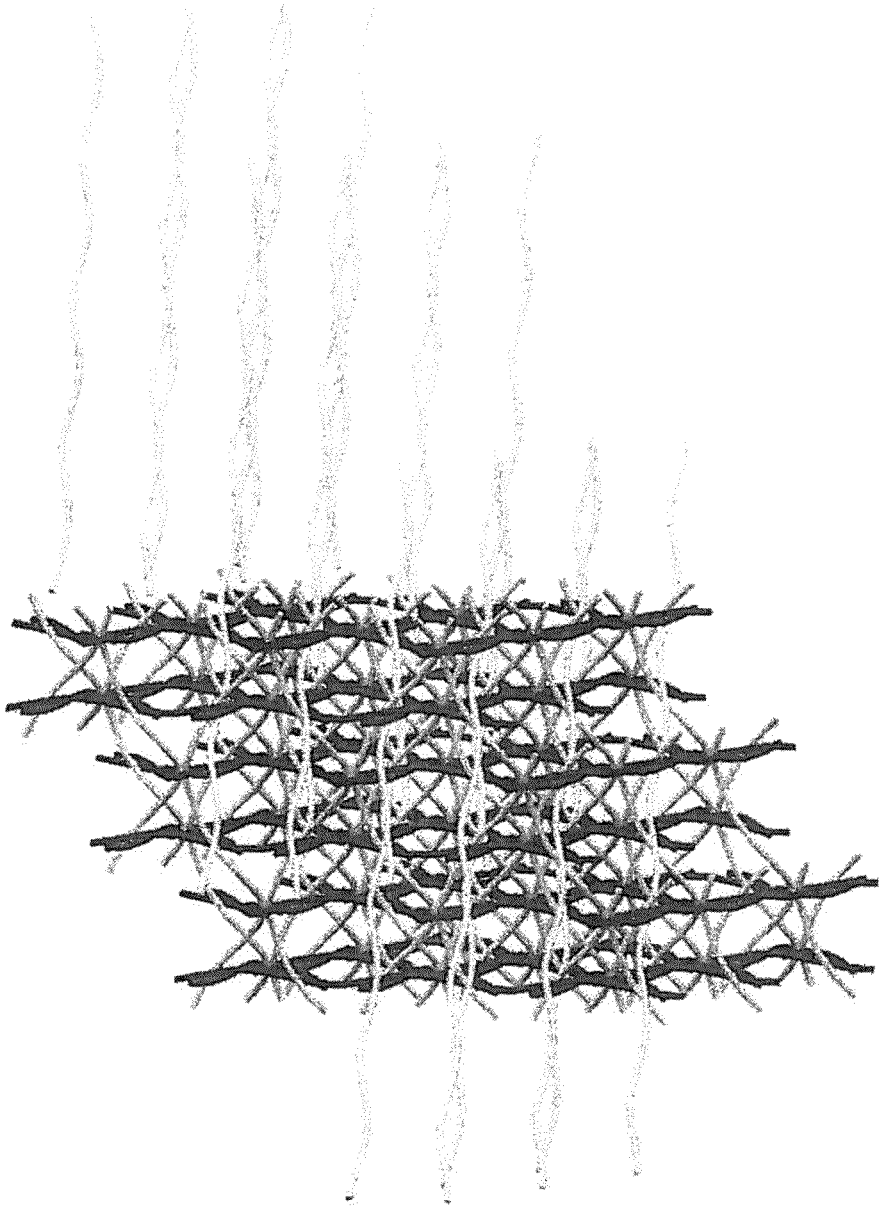

FIGS. 37 to 40 are views illustrating a process of assembling the structure of FIG. 21. First, FIG. 37 illustrates a two-dimensional Kagome-shaped plane which is assembled using plural helical wires disposed in parallel and arranged in first, second and third axial directions on one plane at an azimuth angle of 60 degrees with respect to one another. FIG. 38 illustrates a plurality of the above Kagome-shaped planes arranged at a designated interval in parallel with the x-y plane. FIG. 39 illustrates an inserted or inserting state of helical wires in one direction arranged out-of-plane and having an azimuth angle of 60 or 90 degrees with respect to the helical wires in the two axial directions passing through the respective two-dimensional Kagome-shaped intersections arranged in advance in-plane of FIG. 38 and an angle of 54.7 degrees ($=\cos^{-1}(1\sqrt{3})$) with the x-y plane into the respective two-dimensional Kagome-shaped intersections. FIG. 40 illustrates an inserted or inserting state of helical wires in another direction arranged out-of-plane and having an azimuth angle of 60 or 90 degrees with respect to the helical wires in the three axial directions arranged in advance at the intersections of the helical wires in the two axial direction passing through the respective two-dimensional Kagome-shaped intersections arranged in-plane and an angle of 54.7 degrees ($=\cos^{-1}(1\sqrt{3})$) with the x-y plane into the respective two-dimensional Kagome-shaped intersections in-plane, after insertion of the helical wires of FIG. 39 has been completed. FIG. 41 illustrates an inserted or inserting state of helical wires in another direction arranged out-of-plane and having an azimuth angle of 60 or 90 degrees with respect to the helical wires in the four axial directions arranged in advance at the intersections of the helical wires in the two axial direction passing through the respective two-dimensional Kagome-shaped intersections arranged in-plane and an angle of 54.7 degrees ($=\cos^{-1}(1\sqrt{3})$) with the x-y plane into the respective two-dimensional Kagome-shaped intersections in-plane, after insertion of the helical wires of FIG. 40 has been completed.

Figure 42:
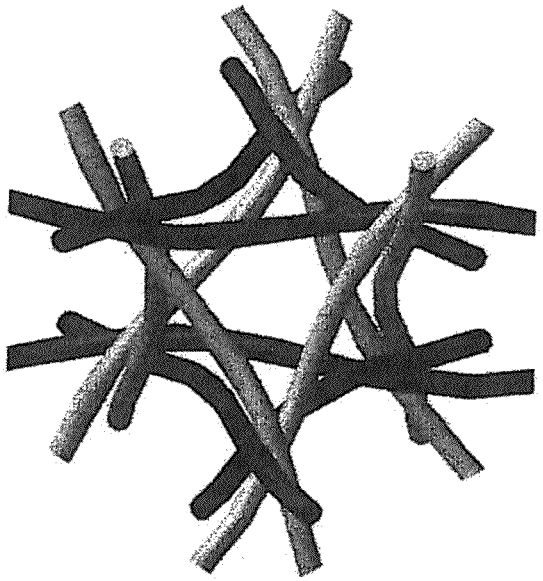
FIG. 42 is a view illustrating a shape of a regular octahedron formed by adjacent wires as a part of a unit cell of the structure of FIG. 21.

The wires in the four directions including the wires in the two axial directions in-plane and the wires in the two axial directions out-of-plane pass through the respective intersections. The wires in the two axial directions out-of-plane passing through the three adjacent intersections of the smallest triangle in the same plane and the wires forming a triangle arranged in another two-dimensional Kagome-shaped plane adjacent to the corresponding plane and parallel with the x-y plane and located directly on or under the above triangle form a regular octahedron. FIG. 42 illustrates such an octahedron.

Figure 22:
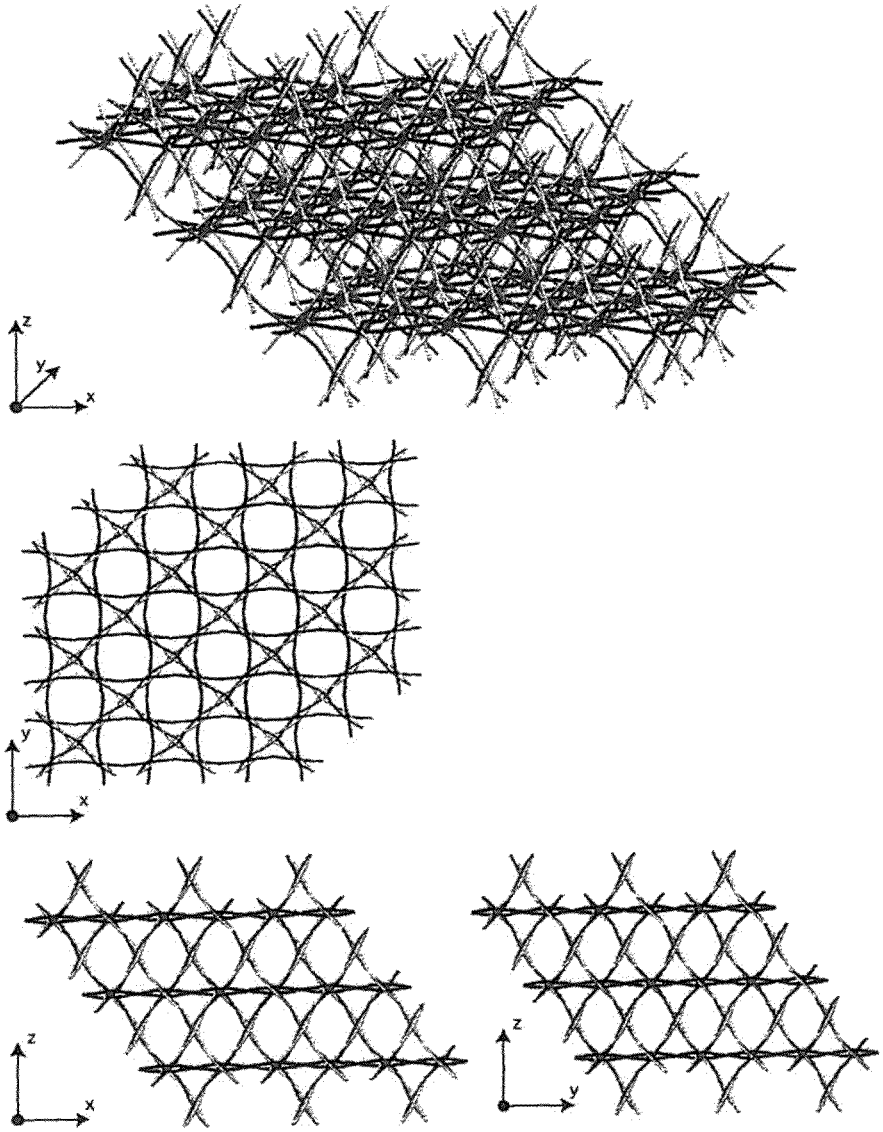
Figure 43:
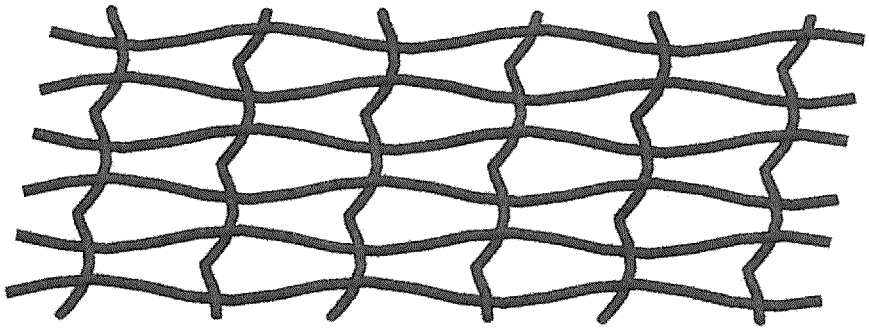
FIGS. 43 to 48 are views illustrating a process of assembling the structure of FIG. 22.
Figure 44:
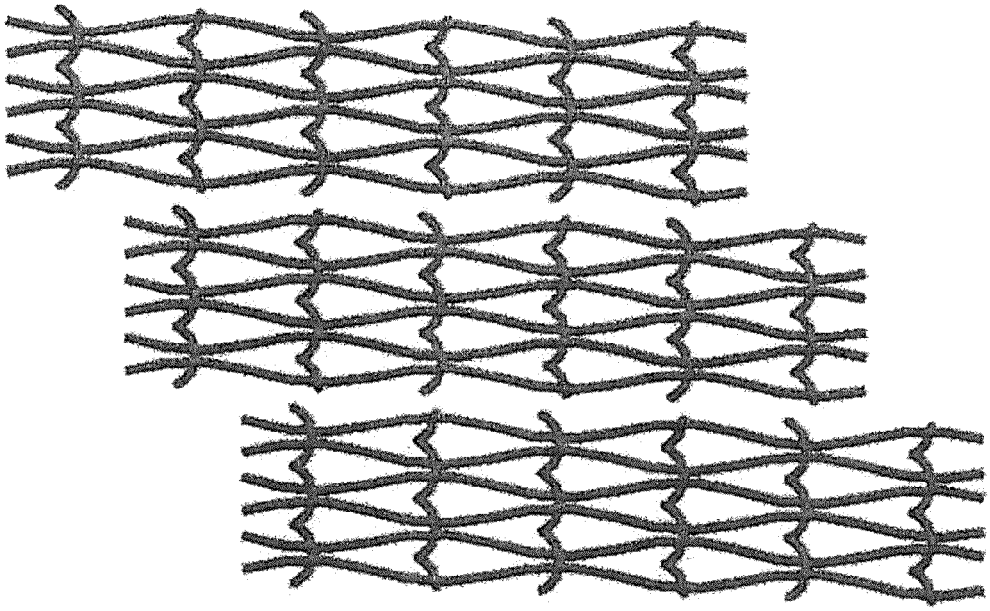
Figure 45:
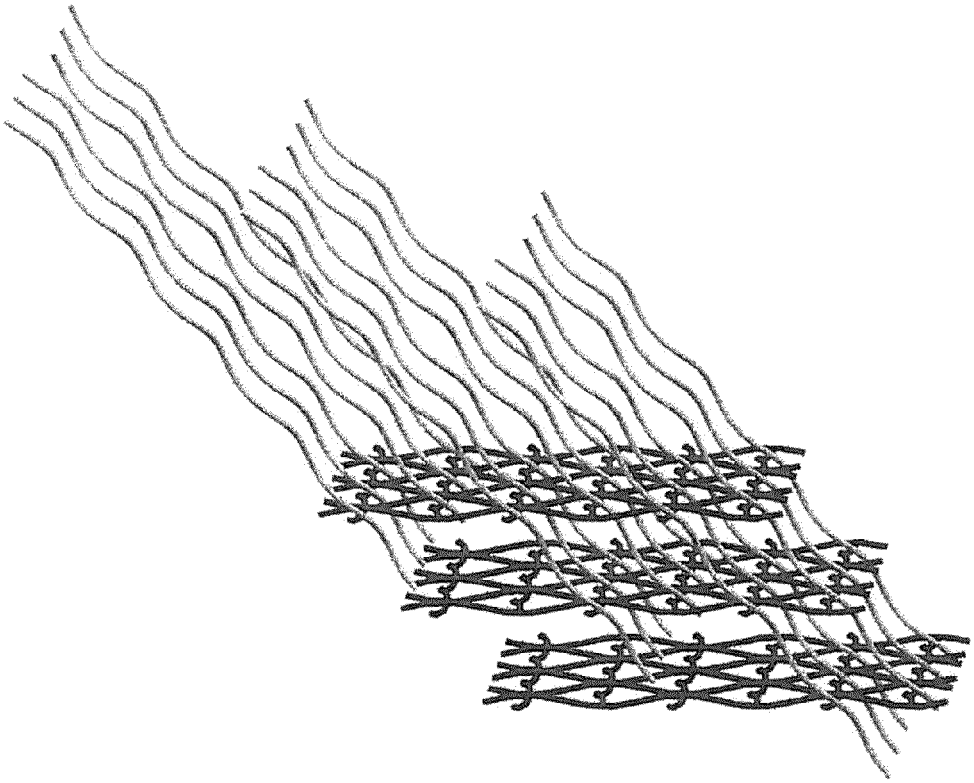
Figure 46:
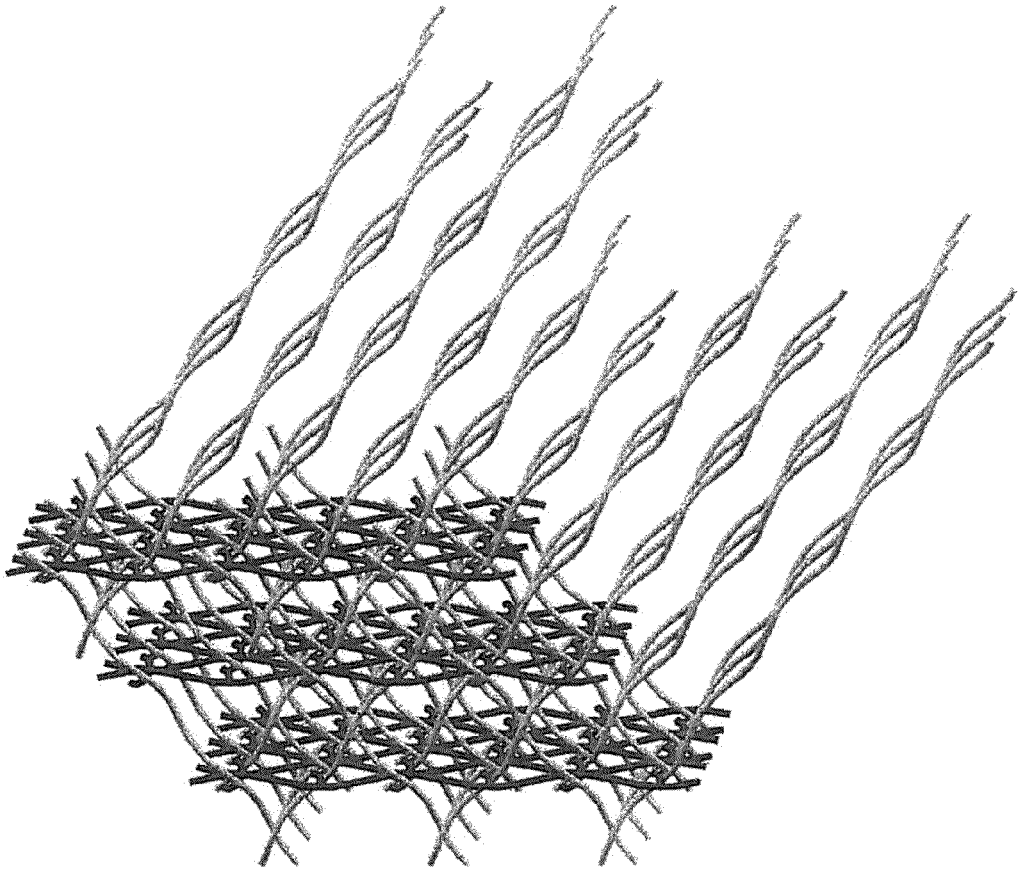
Figure 47:
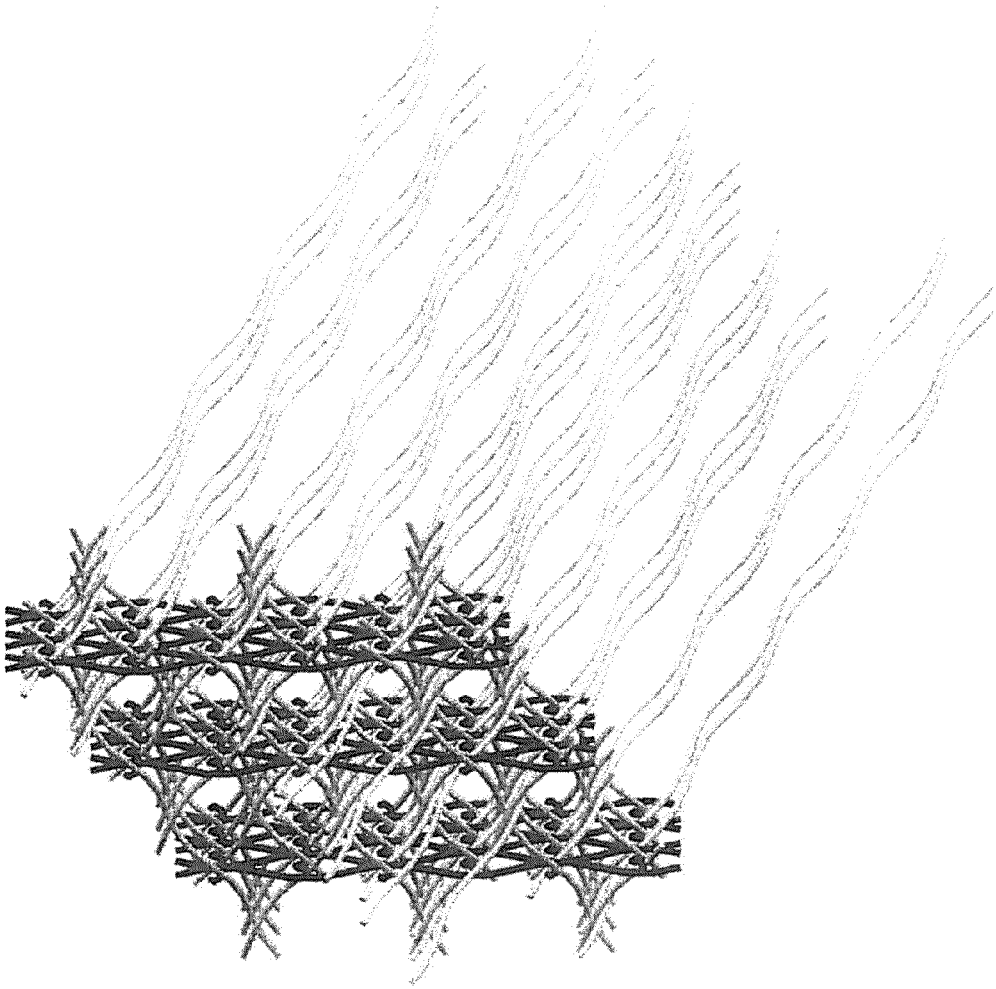
Figure 48:
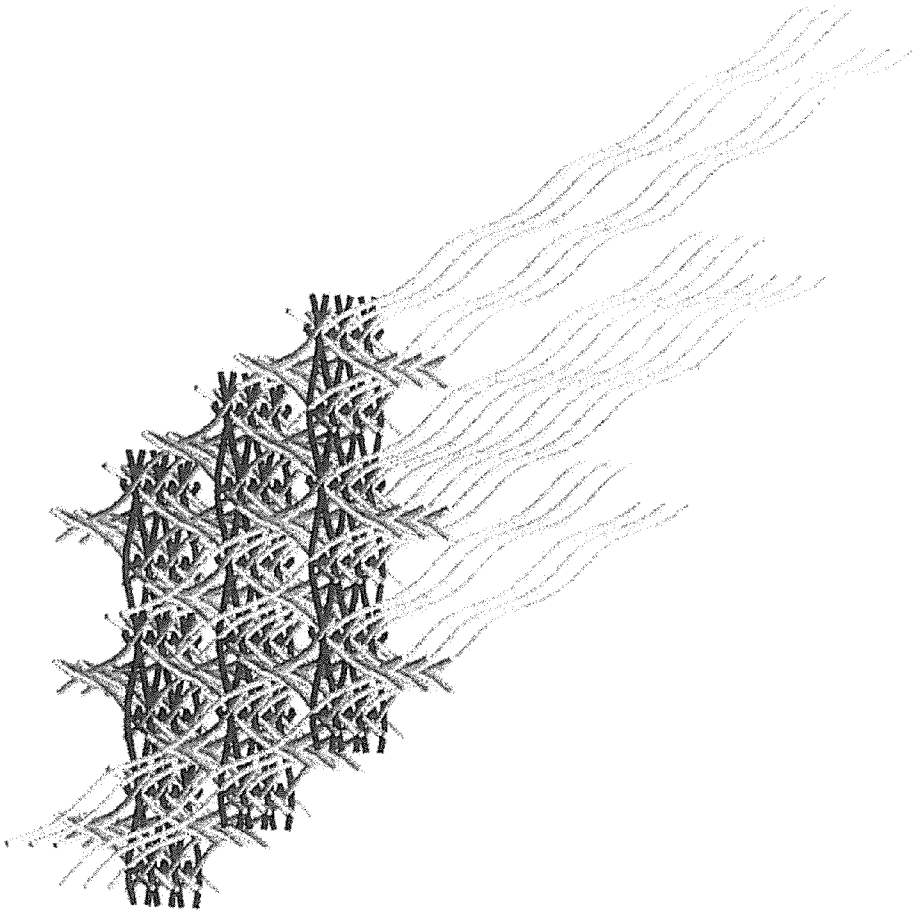

FIGS. 43 to 48 are views illustrating a process of assembling the structure of FIG. 22. First, FIG. 43 illustrates a net-shaped plane having rectangular meshes which is assembled using plural helical wires disposed in parallel and arranged in first and second axial directions on one plane at an azimuth angle of 90 degrees with respect to each other. FIG. 44 illustrates a plurality of the above net-shaped planes arranged at a designated interval in parallel with the x-y plane. FIG. 45 illustrates an inserted or inserting state of helical wires in one axial direction arranged out-of-plane and having an azimuth angle of 60 degrees with respect to the helical wires in the two axial directions and an azimuth angle of 45 degrees with respect to the x-y plane into the intersections of the helical wires in the two axial directions arranged in-plane in FIG. 44. FIG. 46 illustrates an inserted or inserting state of helical wires in another axial direction arranged out-of-plane and having an azimuth angle of 60 degrees with respect to the helical wires in the two axial directions arranged in-plane, an azimuth angle of 90 degrees with respect to the helical wires in the one axial direction arranged in advance out-of-plane and an azimuth angle of 45 degrees with respect to the x-y plane into the intersections of the helical wires in the two axial directions arranged in-plane, after insertion of the helical wires of FIG. 45 has been completed.

Figure 49:
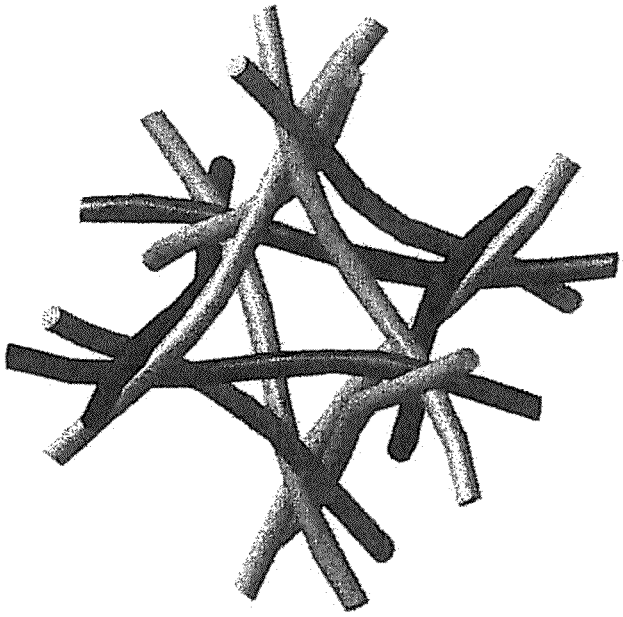
FIG. 49 is a view illustrating a shape of a regular octahedron formed by adjacent wires as a part of a unit cell of the structure of FIG. 22.

The wires in the four directions including the wires in the two axial directions in-plane and the wires in the two axial directions out-of-plane pass through the respective intersections. By the wires in one axial direction out-of-plane passing through the four adjacent intersections of the smallest rectangle in the same plane and extending in the upward direction of the respective intersections and the wires in another axial direction out-of-plane passing through the four adjacent intersections and extending in the downward direction of the respective intersections, the intersections of the wires in the four axial directions out-of-plane are formed at the upper portion and the lower portion of the corresponding rectangle, thereby forming a regular octahedron together with the rectangle in-plane. FIG. 49 illustrates such an octahedron.

A material of the wires of the three-dimensional truss-shaped porous light-weight structures manufactured by the above-described methods is not specially limited, and may employ metal, ceramic, fibers, synthetic resins, fiber-reinforced synthetic resins, etc.

Further, the wires may be firmly bonded at the intersections. In this case, a bonding material is not specially limited, and a liquid-type or spray-type adhesive agent may be employed or bonding may be carried out through brazing, soldering, welding, etc.

Further, the diameter of the wires or the size of the porous light-weight structures is not limited. For example, if iron bars of several meters are used, the porous light-weight structures are applicable to the structural material of a building.

On the other hand, if wires of several mm are used, the porous light-weight structures are applicable to a frame of a fiber-reinforced composite material. For example, a fiber-reinforced composite material having excellent stiffness and toughness may be manufactured by filling a vacant space of the three-dimensional porous light-weight structure in accordance with the present invention used as a basic frame with a liquid-type or semisolid-type resin or metal and then hardening the structure. Further, if the truss-shaped three-dimensional porous light-weight structure in which regular octahedrons and cuboctahedrons are combined, as shown in FIG. 22, is used, a fiber-reinforced composite material may be manufactured by filling only the regular octahedrons having a smaller size with a resin or metal. Such a fiber-reinforced composite material has a small change of properties, and thus may be cut into random shapes. Further, since fibers of the fiber-reinforced composite material cross each other and interfere with each other, delamination or pull-out which occurs in conventional composite materials may be prevented.

The three-dimensional porous light-weight structures in accordance with the present invention are formed by a method in which helical wires are three-dimensionally assembled through a continuous process rather than a method in which net-shaped wires are simply woven and stacked, and respectively have a configuration very similar to the ideal hexahedron truss, Octet truss, and truss in which regular octahedrons and cuboctahedrons are combined, thus having excellent mechanical properties or thermal or aerodynamic properties.

Further, since the intersections of the wires of the three-dimensional porous light-weight structures in accordance with the present invention are bonded through welding, brazing, soldering or using a spray-type adhesive agent, the three-dimensional porous light-weight structures in accordance with the present invention may be applicable to structural materials having high strength and stiffness or porous materials having a large surface area. Moreover, the three-dimensional porous light-weight structure in accordance with the present invention may be applicable to three-dimensional fiber-reinforced composite materials by filling the entirety or a portion of a vacant space of the structure with a resin, metal or an inorganic material.

As described above, in the three-dimensional lattice truss structure composed of helical wires and the manufacturing method thereof in accordance with the present invention, continuous helical wire groups in three or six directions having an azimuth angle of 60 degrees or 90 degrees with respect to one another cross one another in a space so as to be assembled into a configuration similar to the hexahedron truss, the Octet truss, or the truss in which regular octahedrons and cuboctahedrons are combined.

INDUSTRIAL APPLICABILITY

As apparent from the above description, a three-dimensional lattice truss structure composed of helical wires and a manufacturing method thereof in accordance with the present invention may be applicable to fields of mechanical structures, building materials, fiber and composite materials.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. Manufacturing method of three-dimensional porous light-weight structures including Octet truss structure, wherein the formation of the Octet truss structure comprises:

(a) forming plural net-shaped planes, each of which has plural rectangular meshes by arranging plural helical wires in parallel in first and second axial directions on one plane;

(b) arranging the plural net-shaped planes at a designated interval in parallel in a direction perpendicular to the planes; and (c) forming the Octet truss structure by respectively inserting plural helical wires in third to sixth directions into the intersections of the helical wires in the first and second axial directions arranged on the plural planes, wherein:

the helical wires in the first and second axial directions have an azimuth angle of 90 degrees with respect to each other; and the helical wires in the third to sixth axial directions have an azimuth angle of 60 degrees with respect to the helical wires in the two directions arranged at the intersections, and have an azimuth angle of 45 degrees with a plane formed by a first axis and a second axis.

2. Manufacturing method of three-dimensional porous light-weight structures including a truss structure in which regular octahedrons and cuboctahedrons are combined, wherein the formation of the truss structure in which the regular octahedrons and the cuboctahedrons are combined comprises:

(a) forming plural two-dimensional Kagome planes by arranging plural helical wires in parallel in first to third axial directions on one plane;

(b) arranging the plural two-dimensional Kagome planes at a designated interval in parallel in a direction perpendicular to the planes; and (c) forming the truss structure in which the regular octahedrons and the cuboctahedrons are combined by respectively inserting plural helical wires in fourth to sixth directions into the intersections of the helical wires in the three axial directions arranged on the plural two-dimensional Kagome planes, wherein the helical wires in the first to third axial directions have an azimuth angle of 60 degrees with respect to one another, wherein the helical wires in the fourth to sixth axial directions have an azimuth angle of 60 or 90 degrees with respect to the helical wires in the three directions arranged at the intersections, and have an azimuth angle of 54.7 degrees with a plane formed by a first axis to a third axis, wherein the wires in the four directions including the wires in the two axial directions in-plane and the wires in the two axial directions out-of-plane pass through the respective intersections of the helical wires.

3. Manufacturing method of three-dimensional porous light-weight structures including a truss structure in which regular octahedrons and cuboctahedrons are combined, wherein the formation of the truss structure in which the regular octahedrons and the cuboctahedrons are combined comprises:

(a) forming plural net-shaped planes, each of which has plural rectangular meshes by arranging plural helical wires in parallel in first and second axial directions on one plane;

(b) arranging the plural net-shaped planes at a designated interval in parallel in a direction perpendicular to the planes; and (c) forming the truss structure in which the regular octahedrons and the cuboctahedrons are combined by respectively inserting plural helical wires in third to sixth directions into the intersections of the helical wires in the first and second axial directions arranged on the plural planes such that the helical wires in two axial directions cross each intersection, wherein the helical wires in the first and second axial directions have an azimuth angle of 90 degrees with respect to each other, wherein the helical wires in the third to sixth axial directions have an azimuth angle of 60 degrees with respect to the helical wires in the two directions arranged at the intersections, and have an azimuth angle of 45 degrees with a plane formed by a first axis and a second axis, wherein the wires in the four directions including the wires in the two axial directions in-plane and the wires in the two axial directions out-of-plane pass through the respective intersections of the helical wires.

* * * * *